US010588427B2

(12) United States Patent
Mercier et al.

(10) Patent No.: US 10,588,427 B2
(45) Date of Patent: Mar. 17, 2020

(54) LOW PRODUCT INDICATOR FOR SELF FACING MERCHANDISER AND RELATED METHODS

(71) Applicant: Retail Space Solutions LLC, Milwaukee, WI (US)

(72) Inventors: Michael William Mercier, Chicago, IL (US); Daniel Davenport, Chicago, IL (US); Matthew Wills, Grafton, WI (US); Eric Pollpeter, Cedarburg, WI (US)

(73) Assignee: Retail Space Solutions LLC, Milwaukee, WI (US)

( * ) Notice: Subject to any disclaimer, the term of this patent is extended or adjusted under 35 U.S.C. 154(b) by 0 days.

(21) Appl. No.: 15/409,193

(22) Filed: Jan. 18, 2017

(65) Prior Publication Data

US 2017/0273477 A1 Sep. 28, 2017

Related U.S. Application Data

(60) Provisional application No. 62/440,177, filed on Dec. 29, 2016, provisional application No. 62/423,673, filed on Nov. 17, 2016, provisional application No. 62/312,030, filed on Mar. 23, 2016.

(51) Int. Cl.

| | |
|---|---|
| ***A47F 1/12*** | (2006.01) |
| ***A47F 5/00*** | (2006.01) |
| ***A47F 5/08*** | (2006.01) |
| ***G06Q 90/00*** | (2006.01) |

(52) U.S. Cl.

CPC ..... *A47F 1/126* (2013.01); *A47F 5/0018* (2013.01); *A47F 5/0838* (2013.01); *G06Q 90/00* (2013.01)

(58) Field of Classification Search

None

See application file for complete search history.

(56) References Cited

U.S. PATENT DOCUMENTS

| | | | |
|---|---|---|---|
| 2,510,944 | A | 6/1950 | Auerbach |
| 2,598,862 | A | 6/1952 | Tonn |
| 2,674,723 | A | 4/1954 | Hurlbut |
| 2,755,452 | A | 7/1956 | Rogie |

(Continued)

FOREIGN PATENT DOCUMENTS

| | | | |
|---|---|---|---|
| CA | 2781515 | A1 | 12/2012 |
| CN | 2781936 | Y | 5/2006 |

(Continued)

OTHER PUBLICATIONS

Patent Cooperation Treaty, International Searching Authority, Notification of Transmittal of the International Search Report and the Written Opinion of the International Searching Authority or the Declaration issued in International Application No. PCT/US2017/013973, May 25, 2017, 13 pages.

(Continued)

*Primary Examiner* — Omer S Khan

(74) *Attorney, Agent, or Firm* — Andrus Intellectual Property Law, LLP

(57) ABSTRACT

A product display merchandiser comprising a tray, a spring biased pusher slidable within the tray, and a visual indicator comprising at least one light activated by a switch, the switch configured to be actuated when the pusher is within a predetermined portion of the tray.

17 Claims, 16 Drawing Sheets

(56) References Cited

U.S. PATENT DOCUMENTS 3,605,064 A 9/1971 Routh
3,622,938 A 11/1971 Ito
3,886,348 A 5/1975 Jonathan
4,018,497 A 4/1977 Bulanchuk
4,042,291 A 8/1977 Moriyama
4,245,874 A 1/1981 Bishop
4,502,103 A 2/1985 Collins
4,688,869 A 8/1987 Kelly
4,689,726 A 8/1987 Kretzschmar
4,736,279 A 4/1988 Yamai
4,747,025 A 5/1988 Barton
4,799,133 A 1/1989 Strzalko
4,886,462 A 12/1989 Fierro
4,973,796 A 11/1990 Dougherty
4,994,943 A 2/1991 Aspenwall
4,996,636 A 2/1991 Lovett
5,012,936 A 5/1991 Crum
5,022,720 A 6/1991 Fevig
5,034,861 A 7/1991 Sklenak
5,072,343 A 12/1991 Buers
D330,090 S 10/1992 Walter
5,154,641 A 10/1992 McLaughlin
5,190,186 A 3/1993 Yablans
5,205,638 A 4/1993 Squitieri
5,334,037 A 8/1994 Gabrius
5,348,485 A 9/1994 Briechle
5,366,099 A 11/1994 Schmid
5,390,802 A 2/1995 Pappagallo
5,425,648 A 6/1995 Farham
5,476,396 A 12/1995 De Castro
5,542,552 A 8/1996 Yablans
5,553,412 A 9/1996 Briechle
5,605,237 A 2/1997 Richardson
5,608,643 A 3/1997 Wichter
5,639,258 A 6/1997 Clark
5,649,363 A 7/1997 Rankin, VI
5,665,304 A 9/1997 Heinen
5,671,362 A 9/1997 Cowe
5,685,664 A 11/1997 Parham
5,690,415 A 11/1997 Krehl
5,722,747 A 3/1998 Baron
5,722,847 A 3/1998 Haag
5,743,428 A 4/1998 Rankin, VI
5,758,585 A 6/1998 Latchinian
5,791,487 A 8/1998 Dixon
5,816,696 A 10/1998 Beisler
5,831,515 A * 11/1998 Stewart ..... G08B 3/10 340/384.4
5,839,588 A 11/1998 Hawkinson
5,855,283 A 1/1999 Johnson
5,881,910 A 3/1999 Rein
5,894,933 A 4/1999 Crews
5,902,034 A 5/1999 Santosuosso
5,902,150 A 5/1999 Sigl
5,915,824 A 6/1999 Straat
5,924,367 A * 7/1999 Henke ..... A47F 5/0087 108/108
5,924,790 A 7/1999 Ponton
5,964,373 A 10/1999 Hucknall
5,992,652 A 11/1999 Springs
6,093,037 A 7/2000 Lin
6,142,317 A 11/2000 Merl
6,155,438 A 12/2000 Close
6,179,434 B1 1/2001 Saraiji
6,181,299 B1 1/2001 Frederick
6,196,648 B1 3/2001 Henriott
6,231,205 B1 5/2001 Slesinger
D445,615 S 7/2001 Burke
6,254,247 B1 7/2001 Carson
6,259,965 B1 7/2001 Steele
6,269,285 B1 7/2001 Mignault
6,276,810 B1 8/2001 Vosshenrich
6,283,608 B1 9/2001 Straat
6,302,557 B1 10/2001 Santosuosso
6,325,523 B1 12/2001 Santosuosso
6,351,964 B1 3/2002 Brancheau
6,364,273 B1 4/2002 Otema
6,375,015 B1 4/2002 Wingate
6,382,431 B1 5/2002 Burke
6,430,467 B1 8/2002 Amelio
6,443,317 B1 9/2002 Brozak, Jr.
6,464,089 B1 10/2002 Rankin, VI
6,484,891 B2 11/2002 Burke
6,502,012 B1 12/2002 Nelson
6,527,565 B1 3/2003 Johns
6,539,280 B1 3/2003 Valiulis
6,550,269 B2 4/2003 Rudick
6,558,017 B1 5/2003 Saraiji
6,561,617 B2 5/2003 Silverbrook
6,599,145 B2 7/2003 Singh
6,622,410 B2 9/2003 Wilkes et al.
6,622,874 B1 9/2003 Hawkinson
6,671,578 B1 12/2003 Amelio
6,684,126 B2 1/2004 Omura
6,735,498 B2 5/2004 Hertz
6,749,207 B2 6/2004 Nadeau
D493,009 S 7/2004 Ken
6,772,888 B2 8/2004 Burke
6,808,407 B1 10/2004 Cannon
6,827,463 B2 12/2004 Chuang
6,827,465 B2 12/2004 Shemitz
6,859,677 B2 2/2005 Mitterholzer
6,886,699 B2 5/2005 Johnson
6,918,679 B2 7/2005 Wu
D521,286 S 5/2006 Colmenares
7,036,947 B2 5/2006 Chuang
7,056,007 B2 6/2006 Chiu
7,066,342 B2 6/2006 Baechle
7,111,735 B2 9/2006 Lowry
7,121,675 B2 10/2006 Ter-Hovhannisian
7,137,517 B2 11/2006 Lowry
7,163,305 B2 1/2007 Bienick
7,175,034 B2 2/2007 Nook
7,184,857 B1 2/2007 Hertz
7,233,241 B2 6/2007 Overhultz
7,286,696 B2 10/2007 Erickson
7,289,656 B2 10/2007 Engelbart
7,293,663 B2 11/2007 Lavery
7,347,335 B2 3/2008 Rankin, VI
7,367,685 B2 5/2008 Moll
7,419,062 B2 9/2008 Mason
7,428,327 B2 9/2008 Erickson
7,434,951 B2 10/2008 Bienick
7,463,368 B2 12/2008 Morden
7,477,780 B2 1/2009 Boncyk
7,513,637 B2 4/2009 Kelly
7,529,597 B1 5/2009 Hertz
7,535,337 B2 5/2009 Overhultz
7,545,517 B2 6/2009 Rueb
7,551,765 B2 6/2009 Thomas
7,574,822 B1 8/2009 Moore
7,597,448 B1 10/2009 Zarian
7,597,462 B2 10/2009 Misof
7,600,887 B2 10/2009 Sherman
7,614,350 B2 11/2009 Tuttle
7,614,761 B2 11/2009 Tanaka
7,641,072 B1 1/2010 Vlastakis
7,664,305 B2 2/2010 Erickson
7,681,744 B2 3/2010 Johnson
7,689,460 B2 3/2010 Natori
7,693,757 B2 4/2010 Zimmerman
7,703,614 B2 4/2010 Schneider
7,726,831 B2 6/2010 Shibusawa
7,758,233 B2 7/2010 Chang
7,766,502 B2 8/2010 Tress
7,792,711 B2 9/2010 Swafford
7,794,132 B2 9/2010 Cunius
7,806,543 B2 10/2010 Swofford
7,823,734 B2 11/2010 Hardy
7,824,055 B2 11/2010 Sherman
7,824,056 B2 11/2010 Madireddi
7,824,057 B2 11/2010 Shibusawa
7,854,334 B2 12/2010 Nagel
7,871,176 B2 1/2011 Kelly

(56) References Cited

U.S. PATENT DOCUMENTS 7,909,183 B2 3/2011 Oh
7,929,750 B2 4/2011 Erickson
7,940,181 B2 5/2011 Ramachandra
7,949,568 B2 5/2011 Fano
7,950,817 B2 5/2011 Zulim
7,954,979 B2 6/2011 Sommers
7,976,181 B2 7/2011 Kelly
8,002,181 B2 8/2011 Ulrich
8,002,441 B2 8/2011 Barkdoll
8,009,864 B2 8/2011 Linaker
8,047,657 B2 11/2011 Ikeda
8,066,398 B2 11/2011 Hartman
8,068,659 B2 11/2011 Engelbart
8,070,309 B2 12/2011 Otsuki
8,075,160 B1 12/2011 Zarian
8,083,078 B2 12/2011 Omura
8,113,678 B2 2/2012 Babcock
8,118,164 B2 2/2012 Brown
8,131,055 B2 3/2012 Clarke
8,136,956 B2 3/2012 Oketani
8,142,047 B2 3/2012 Acampora
8,164,274 B2 4/2012 Pas
8,172,096 B2 5/2012 Van De Steen
8,177,404 B2 5/2012 Weng
8,189,855 B2 5/2012 Opalach
8,190,289 B2 5/2012 Lockwood
8,190,497 B2 5/2012 O'Dell
8,210,367 B2 7/2012 Nagel
8,215,795 B2 7/2012 Pichel
8,224,720 B2 7/2012 Cohen
8,260,456 B2 9/2012 Siegel
8,292,095 B2 10/2012 Howlett
8,319,607 B2 11/2012 Grimlund
8,353,425 B2 1/2013 Lockwood
8,386,075 B2 2/2013 Lockwood
8,413,826 B2 4/2013 Schneider
8,413,843 B2 4/2013 Vardaro
8,419,205 B1 4/2013 Schmuckle
8,429,004 B2 4/2013 Hamilton
8,433,432 B2 4/2013 Matsushita
8,443,988 B2 5/2013 Niederhuefner
8,448,815 B2 5/2013 Sholl
8,453,851 B2 6/2013 Ciesick
8,490,424 B2 7/2013 Roche
8,506,109 B2 8/2013 Stukenberg
8,545,045 B2 10/2013 Tress
8,562,167 B1 10/2013 Meier
8,581,738 B2 11/2013 Maggiore
8,602,230 B2 12/2013 Bergdoll
8,607,997 B2 12/2013 Bergdoll
8,616,757 B2 12/2013 Leadford
8,630,924 B2 1/2014 Groenevelt
8,631,956 B2 1/2014 Dowd
8,646,935 B2 2/2014 Karan
8,651,296 B2 2/2014 Beaty
8,676,377 B2 3/2014 Siegel
8,678,232 B2 3/2014 Mockus
8,684,268 B2 4/2014 Pas
8,695,878 B2 4/2014 Burnside
8,720,702 B2 5/2014 Nagel
8,746,916 B2 6/2014 Oketani
8,800,811 B2 8/2014 Sherretts
8,812,378 B2 8/2014 Swafford
8,814,399 B2 8/2014 Osawa
8,820,545 B2 9/2014 Kologe
8,823,355 B2 9/2014 Hachmann
8,823,521 B2 9/2014 Overhultz
8,858,013 B2 10/2014 Attey
8,864,334 B2 10/2014 Swafford, Jr.
8,908,903 B2 12/2014 Deng
8,910,801 B2 12/2014 Johnson
8,925,745 B2 1/2015 Theisen
8,938,396 B2 1/2015 Swafford
8,939,779 B1 1/2015 Lindblom
8,941,495 B2 1/2015 Wiese
8,941,645 B2 1/2015 Grimaud
8,972,291 B2 3/2015 Rimnac
8,978,901 B2 3/2015 Hogeback
8,978,903 B2 3/2015 Hardy
8,978,904 B2 3/2015 Hardy
8,979,296 B2 3/2015 Wiemer
8,985,352 B2 3/2015 Bergdoll
8,998,005 B2 4/2015 Hardy
9,016,484 B2 4/2015 Kologe
9,022,637 B2 5/2015 Meyer
9,033,239 B2 5/2015 Winkel
9,038,833 B2 5/2015 Ciesick
9,044,089 B1 6/2015 Sandhu
9,044,105 B2 6/2015 McClaughry
9,052,994 B2 6/2015 Lockwood
9,057,513 B2 6/2015 Lindblom
9,070,261 B2 6/2015 Hardy
9,072,394 B2 7/2015 Hardy
9,091,587 B2 7/2015 Kawamura
9,101,230 B2 8/2015 Sosso
9,107,497 B1 8/2015 Al-Habsi
9,107,515 B2 8/2015 Hardy
9,119,488 B2 9/2015 Lockwood
9,121,583 B2 9/2015 Takeuchi
9,129,494 B2 9/2015 Valiulis
9,131,787 B2 9/2015 Berglund
9,138,075 B2 9/2015 Hardy
9,138,076 B2 9/2015 Hardy
9,149,130 B2 10/2015 Yuen
9,149,132 B2 10/2015 Hardy
9,167,914 B2 10/2015 Rankin, VI
9,179,788 B2 11/2015 Hardy
9,185,999 B2 11/2015 Hardy
9,188,291 B2 * 11/2015 Cassidy ..... F21S 4/28
9,204,736 B2 12/2015 Lindblom
9,222,645 B2 12/2015 Breslow
9,228,735 B2 1/2016 Liu
9,239,136 B1 1/2016 Petersen
9,254,049 B2 2/2016 Nagel
9,279,544 B1 3/2016 Dankelmann
9,364,100 B2 6/2016 Browning
9,384,684 B2 7/2016 Theisen
9,404,645 B1 8/2016 Feng
9,424,446 B2 8/2016 Baarman
9,456,704 B2 10/2016 Bhargava
9,483,896 B2 11/2016 Lockwood
9,509,110 B1 11/2016 Buck
9,691,308 B2 6/2017 Meyer
9,775,447 B2 10/2017 Wiemer
9,829,178 B2 11/2017 Breslow
9,986,852 B2 6/2018 Chenoweth
2002/0072323 A1 6/2002 Hakemann
2002/0146282 A1 10/2002 Wilkes
2002/0147597 A1 10/2002 Connors
2002/0171335 A1 11/2002 Held
2004/0050811 A1 3/2004 Leahy
2004/0073334 A1 4/2004 Terranova
2004/0117243 A1 6/2004 Chepil
2004/0208372 A1 10/2004 Boncyk
2005/0040123 A1 2/2005 Ali
2005/0171854 A1 8/2005 Lyon
2005/0173605 A1 8/2005 Villeneuve
2005/0254262 A1 11/2005 Chiu
2005/0279722 A1 12/2005 Ali
2006/0067089 A1 3/2006 Hocquard
2006/0071774 A1 4/2006 Brown
2006/0097875 A1 5/2006 Ott
2006/0207778 A1 9/2006 Walter
2007/0022644 A1 2/2007 Lynch
2007/0042614 A1 2/2007 Marmaropoulos
2007/0273513 A1 11/2007 White
2007/0290585 A1 12/2007 Moeller
2008/0055914 A1 3/2008 O'Rourke
2008/0077510 A1 3/2008 Dielemans
2008/0083353 A1 4/2008 Tuttle
2008/0121146 A1 5/2008 Burns
2008/0144934 A1 6/2008 Raynaud
2008/0151535 A1 6/2008 De Castris
2008/0277361 A1 11/2008 Primiano

(56) References Cited

U.S. PATENT DOCUMENTS

2008/0278932 A1 11/2008 Tress
2008/0306787 A1 12/2008 Hamilton
2009/0037244 A1 2/2009 Pemberton
2009/0039040 A1 2/2009 Johnson
2009/0223916 A1 9/2009 Kahl
2009/0279295 A1 11/2009 Van Der Poel
2010/0087953 A1 4/2010 Garson
2010/0089846 A1 4/2010 Navarro Ruiz
2010/0102685 A1 4/2010 Ward
2010/0103701 A1 4/2010 Bartlett
2010/0195317 A1 8/2010 Oketani
2010/0201522 A1 8/2010 White
2011/0044030 A1 2/2011 Pichel
2011/0087369 A1* 4/2011 Bauer ..... A47F 1/04 700/232
2011/0203148 A1 8/2011 Li
2011/0203496 A1 8/2011 Garneau
2011/0204009 A1 8/2011 Karan
2011/0215060 A1 9/2011 Niederhuefner
2011/0218889 A1 9/2011 Westberg
2011/0273867 A1 11/2011 Horst
2011/0304316 A1 12/2011 Hachmann
2012/0230018 A1 9/2012 Wiemer
2012/0233041 A1 9/2012 O'Dell
2012/0274189 A1 11/2012 Attey
2012/0279934 A1 11/2012 Thomas
2012/0281095 A1 11/2012 Trenciansky
2012/0308969 A1 12/2012 Rataul
2012/0310398 A1 12/2012 Rataul
2012/0310570 A1 12/2012 Pyne
2013/0024023 A1 1/2013 Siegel
2013/0107498 A1 5/2013 McClaughry
2013/0107501 A1 5/2013 Ewald
2013/0144416 A1 6/2013 Rataul
2013/0155815 A1 6/2013 Wulff
2013/0176398 A1 7/2013 Bonner
2013/0226742 A1 8/2013 Johnson
2013/0229789 A1 9/2013 Yoshida
2013/0238516 A1 9/2013 Moock
2013/0286651 A1 10/2013 Takeuchi
2013/0299439 A1 11/2013 Sid
2013/0337668 A1 12/2013 Ernest
2013/0341292 A1 12/2013 Johnson
2013/0343014 A1 12/2013 Browning
2014/0006229 A1 1/2014 Birch
2014/0008382 A1* 1/2014 Christianson ..... G07F 11/38 221/4
2014/0009282 A1* 1/2014 Baloa Welzien ..... G04G 11/00 340/539.11
2014/0009372 A1 1/2014 Fernando
2014/0032379 A1 1/2014 Schuetz
2014/0055978 A1 2/2014 Gantz
2014/0055987 A1 2/2014 Lindblom
2014/0057604 A1 2/2014 Kolanowski
2014/0104826 A1 4/2014 Bergdoll
2014/0110481 A1 4/2014 Burnside
2014/0129395 A1 5/2014 Groenovelt
2014/0153279 A1 6/2014 Weyer
2014/0175034 A1 6/2014 Hardy
2014/0201040 A1 7/2014 Birch
2014/0201041 A1 7/2014 Meyer
2014/0201042 A1* 7/2014 Meyer ..... G06Q 10/087 705/28
2014/0207606 A1 7/2014 Harrison
2014/0224875 A1 8/2014 Slesinger
2014/0254136 A1 9/2014 Oraw
2014/0291346 A1 10/2014 Mockus
2014/0299620 A1 10/2014 Swafford
2014/0305889 A1 10/2014 Vogler
2014/0316916 A1 10/2014 Hay
2014/0324642 A1 10/2014 Winkel
2014/0333541 A1 11/2014 Lee
2014/0344118 A1 11/2014 Parpia
2014/0353265 A1 12/2014 Rankin VI
2015/0024615 A1 1/2015 Lindblom
2015/0026020 A1 1/2015 Overhultz
2015/0036326 A1 2/2015 MacIulewicz
2015/0041616 A1* 2/2015 Gentile ..... G06Q 10/087 248/550
2015/0046299 A1 2/2015 Yan
2015/0053237 A1* 2/2015 Lee ..... A47L 15/4295 134/18
2015/0055328 A1 2/2015 Irii
2015/0068991 A1 3/2015 Kostka
2015/0070928 A1 3/2015 Rau
2015/0073947 A1 3/2015 Higgins
2015/0076093 A1 3/2015 Theisen
2015/0079823 A1 3/2015 Lindblom
2015/0088701 A1 3/2015 Desmarais
2015/0088703 A1 3/2015 Yan
2015/0123973 A1 5/2015 Larsen
2015/0125835 A1 5/2015 Wittich
2015/0128398 A1 5/2015 Benlevi
2015/0134403 A1 5/2015 Schwartz
2015/0157142 A1* 6/2015 Turner ..... A47F 1/125 211/59.3
2015/0160651 A1 6/2015 Tateno
2015/0173529 A1 6/2015 Hester-Redmond
2015/0193723 A1 7/2015 Carbonell
2015/0193759 A1 7/2015 Fukuda
2015/0235502 A1 8/2015 Lockwood
2015/0241034 A1 8/2015 Dankelmann
2015/0241035 A1 8/2015 Dankelmann
2015/0289680 A1 10/2015 Sosso
2016/0061429 A1 3/2016 Waalkes
2016/0091177 A1 3/2016 Houle
2016/0097516 A1 4/2016 Howard
2016/0104985 A1 4/2016 Ewing
2016/0157635 A1 6/2016 Hardy
2016/0174733 A1 6/2016 Cinici
2016/0209941 A1* 7/2016 Hadas ..... G06F 3/011
2016/0213168 A1 7/2016 Nuttall
2016/0313051 A1 10/2016 Alt
2017/0237246 A1* 8/2017 Janovec ..... H02G 3/14 248/548
2017/0303704 A1* 10/2017 Taylor ..... A47F 1/125
2018/0047243 A1* 2/2018 Swafford, Jr. ..... G07F 11/38
2018/0107973 A1 4/2018 Overhultz
2018/0242756 A1 8/2018 Berg et al.

FOREIGN PATENT DOCUMENTS

CN 101574214 11/2009
CN 202681155 U 1/2013
CN 204862262 12/2015
CN 205560499 U 9/2016
DE 19531866 2/1997
DE 20111800 10/2001
DE 10153495 A1 5/2003
DE 102010050500 5/2012
DE 202014001867 U1 3/2014
EP 268209 A2 5/1988
EP 0441354 A1 8/1991
EP 0683998 11/1995
EP 1057164 A1 12/2000
EP 1541064 A1 6/2005
EP 1579789 A1 9/2005
EP 2220965 8/2010
EP 2292120 3/2011
EP 2732729 A1 5/2014
GB 2291788 2/1996
GB 2297896 8/1996
GB 2325148 11/1998
GB 2359405 8/2001
GB 2390214 A 12/2003
RU 2014112705 10/2015
TW 201513811 A 4/2015
WO 1995016375 6/1995
WO 9708667 3/1997
WO 9908950 2/1999
WO 2000024297 A1 5/2000
WO 2003060839 7/2003
WO 03079852 A1 10/2003

(56) References Cited

FOREIGN PATENT DOCUMENTS

| | | | |
|---|---|---|---|
| WO | 2005023060 | A1 | 3/2005 |
| WO | 2006023954 | | 3/2006 |
| WO | 2006067396 | | 6/2006 |
| WO | 2007140161 | | 12/2007 |
| WO | 2007146740 | | 12/2007 |
| WO | 2008152973 | A1 | 12/2008 |
| WO | 2010024507 | A1 | 3/2010 |
| WO | 2011062727 | | 11/2011 |
| WO | 2011159995 | | 12/2011 |
| WO | 2012009822 | | 1/2012 |
| WO | 2012015361 | A1 | 2/2012 |
| WO | 2012018774 | | 2/2012 |
| WO | 2012074781 | | 6/2012 |
| WO | 2012165190 | | 12/2012 |
| WO | 2012165191 | A1 | 12/2012 |
| WO | 2013192487 | | 12/2013 |
| WO | 2013192491 | | 12/2013 |
| WO | 2014137620 | | 9/2014 |
| WO | 2014173629 | A1 | 10/2014 |
| WO | 2014200998 | | 12/2014 |
| WO | 2015061429 | | 4/2015 |
| WO | 2015061437 | | 4/2015 |
| WO | 2017074891 | | 5/2017 |

OTHER PUBLICATIONS

Intelectual Property Office, British Examination Report under Section 18(3) Corresponding to Application No. GB1414037.0, dated Apr. 13, 2017, 6 pp.

Intellectual Property Office, British Search Report under Section 17(5) for GB1414037.0, dated Dec. 1, 2014 (pp. 3).

Patent Treaty Cooperation, International Search Report and Written Opinion for PCT/GB2015/052296 dated Feb. 16, 2016 (pp. 17).

Streater, Streatlite Connector specifications page, Jun. 8, 2012, 1 p.

Trinity LLC, Trinity Credentials Presentation, Jul. 2013, 10 pp. (cover & title pp., 3, 13-18, 32).

Fixtures Close Up, Pusher Paddle Message Rant, Jul. 28, 2010, 14 pp.

Patent Cooperation Treaty, International Searching Authority, Notification of Transmittal of the International Search Report and the Written Opinion of the International Searching Authority, or the Declaration issued in International Application No. PCT/US2017/057225, Apr. 12, 2018, 9 pp.

DCI-Artform, Grocery.dcim.com/Products/SpaceGrid-I.aspx, "SpaceGrid I Trays-Enhance Frozen Food Appeal and Profitability", 2014, 3 pp.

DCI-Artform, Grocery.dcim.com/Products/SpaceGrid-II.aspx, "SpaceGrid II Trays-Maximize Profitability in Key Store Perimeter Categories", 2014, 2 pp.

Phoenix Displays LLC, Phoenixdisplays.com/displays.html, "Phoenix Displays LLC—Manufacturer of Forward-Facing Product Displays", 2014, 3 pp.

Trion Industries, Inc., Triononline.com/product/wonderfar-merchandising-system/, "Trion Wonderbar Merchandising System", 2017, 2 pp.

International Search Report issued for PCT/US12/28250, dated Jul. 5, 2012.

Pos Tuning Udo Vobhenrich GMBH & Co., KG, "Pos-T—Successful Display of Tobacco Products," brochure, Sep. 9, 2016, 20 pp.

* cited by examiner

LOW PRODUCT INDICATOR FOR SELF FACING MERCHANDISER AND RELATED METHODS

CROSS REFERENCE TO RELATED APPLICATIONS

This application claims the benefit of U.S. Provisional Application No. 62/440,177, filed Dec. 29, 2016, which claims the benefit of U.S. Provisional Application No. 62/423,673, filed Nov. 17, 2016, which claims the benefit of U.S. Provisional Application No. 62/312,030, filed Mar. 23, 2016, all of which are incorporated herein by reference in their entirety.

FIELD

This invention relates generally to product displays and, more particularly, to merchandisers for front-facing product merchandiser for displaying and dispensing product to consumers, low product indicators for same and related methods.

BACKGROUND

Product displays, such as merchandisers, are frequently used in retail environments to display products for sale. It is advantageous for these product displays to be configured to provide consumers easy access to the displayed product, to display the product cleanly and in an unobstructed manner so that product brands are readily visible and the store shelves look full or stocked at most times (also known as fronting), and to facilitate easy installation and restocking or reloading by store employees. To accomplish this, many different forms of displays have been developed that are front-facing or self-facing. For example, there are shelf management systems that mount directly on the shelf, bar mounted systems that replace shelves and suspend from a bar, grid-mounted systems that replace shelves and suspend from a grid system. In addition, there are often two versions of these systems: one gravity fed and the other utilizing a biased pusher or paddle to push the stocked product forward as items are removed from a shelf. Another benefit of these types of displays is that they are typically setup to keep the inventory as new and fresh as possible and to sell off all existing inventory before allowing newer or replacement product to be purchased (e.g., a concept often referred to as "first in first out" or FIFO). Without these systems, retailers and/or product suppliers are forced to spend much more time and resources (and therefore money) on monitoring, organizing and fronting displayed product and typically end up doing so in a less efficient manner with less desirable results, such as having newer product stocked in front of older product increasing the likelihood of spoilage or product failing to be sold by the "sell by" date.

One problem with conventional merchandisers is that while they do not require to be manually faced, they do require employees to continuously check the product displays to determine if restocking is necessary. If they are not regularly checked they may run out of product, which results in lost sales.

While some conventional merchandisers have a physical flag attached to the merchandiser that will alert store associates when restocking is necessary, they require complex mechanical means to be visually apparent. In addition, such systems typically require retailers to purchase an entire new line of product displays that have such technology integrated therein.

Accordingly, it has been determined that a need exists for improved low product indicators for display merchandisers that overcome the aforesaid problems and shortcomings and improved methods relating to same.

BRIEF DESCRIPTION OF THE FIGURES

Embodiments of the invention are illustrated in the figures of the accompanying drawings in which.

Elements in the figures are illustrated for simplicity and clarity and have not necessarily been drawn to scale or to include all features, options or attachments. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. Certain actions and/or steps may be described or depicted in a particular order of occurrence while those skilled in the art will understand that such specificity with respect to sequence is not actually required. The terms and expressions used herein have the ordinary technical meaning as is accorded to such terms and expressions by persons skilled in the technical field as set forth above except where different specific meanings have otherwise been set forth herein.

DESCRIPTION OF THE EMBODIMENTS

Figure 1A:
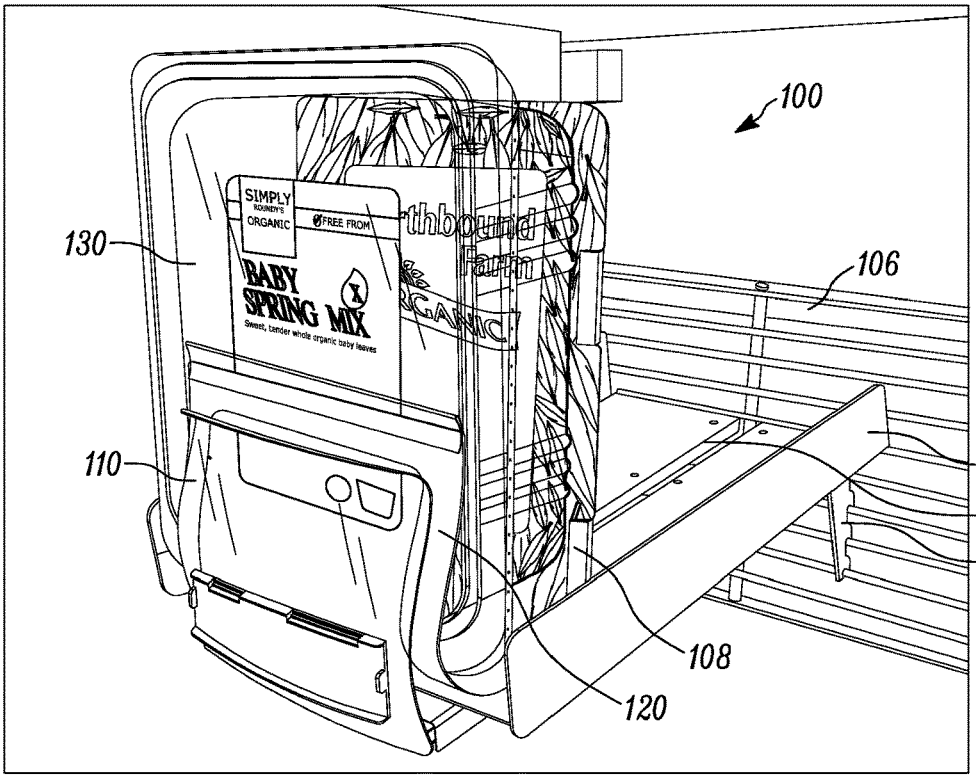
FIG. 1A is a perspective view of a product display merchandiser according to some embodiments of the present invention illustrating a low product indicator using a flexible indicator that can be retrofit for use with existing product displays or merchandisers.
Figure 1B:
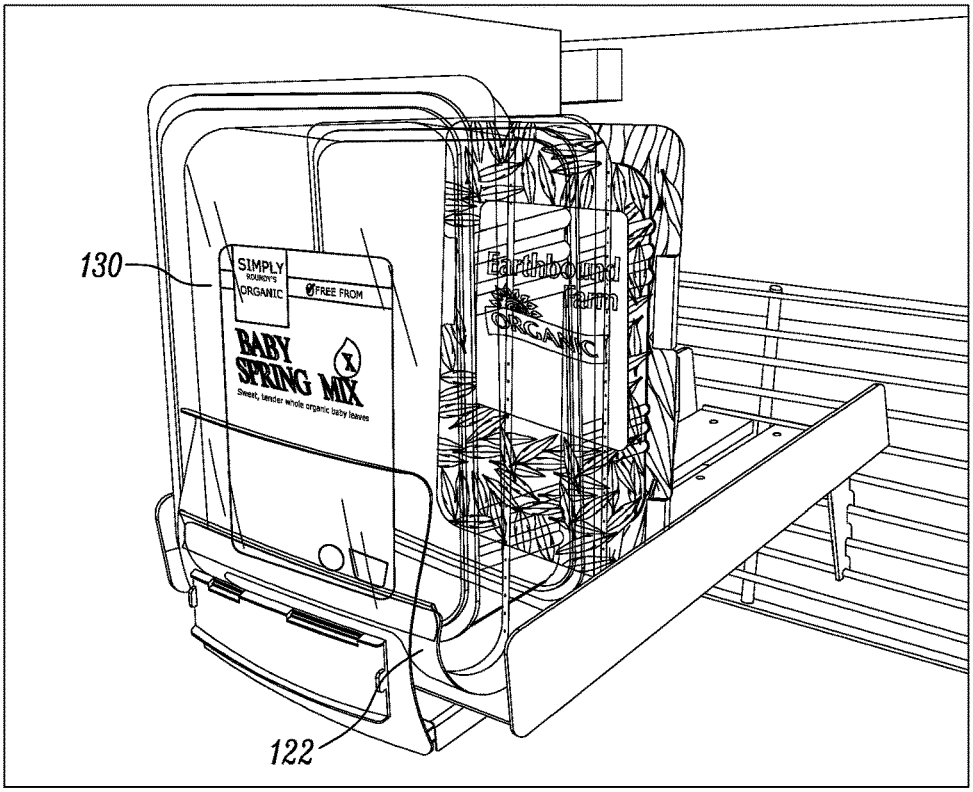
FIG. 1B is a perspective view of the low product indicator of FIG. 1A illustrating the visibility of the visual indicator as product is depleted from the merchandiser.
Figure 1C:
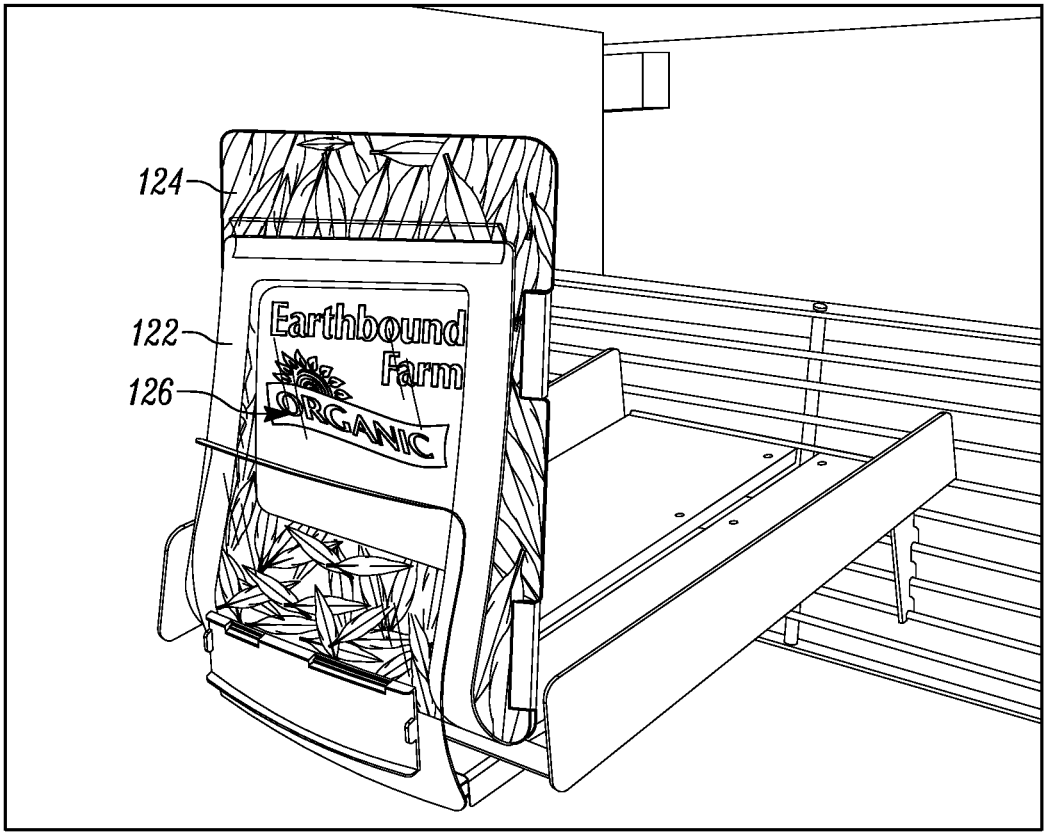
FIG. 1C is a similar perspective view of the low product indicator of FIG. 1B, but illustrating the increased visibility of the visual indicator as product is fully depleted from the merchandiser.
Figure 2A:
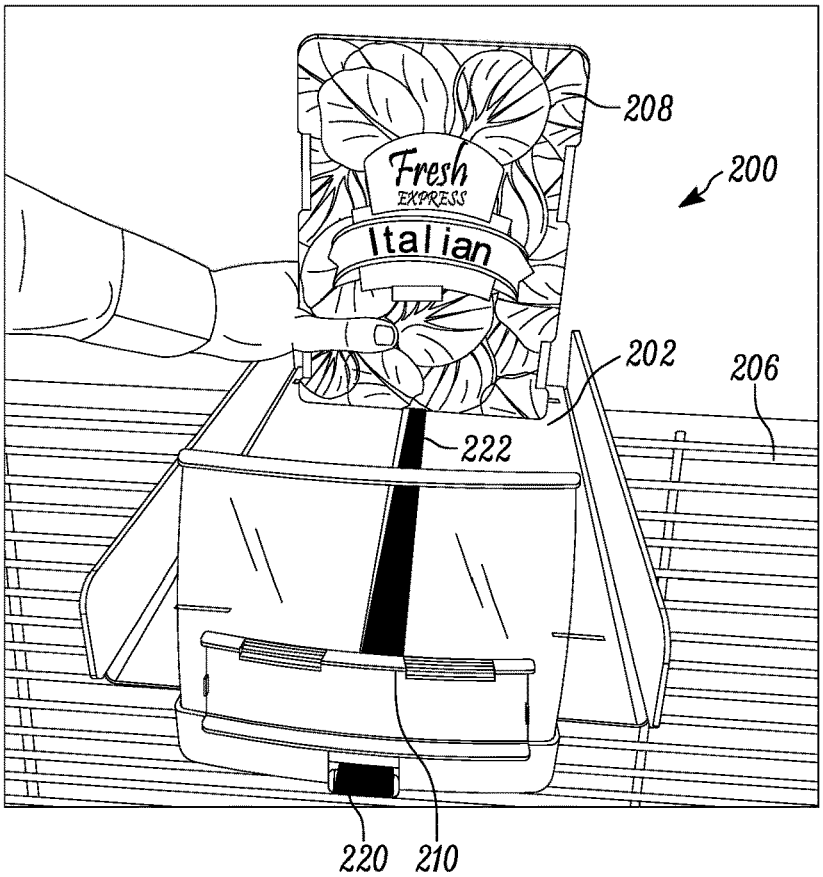
FIG. 2A is a front view of a product display merchandiser having a low product indicator in according to some embodiments of the present invention with the pusher in a first position (e.g., fully stocked position) and the indicator indicating a first status of the merchandiser (e.g., fully stocked).
Figure 2B:
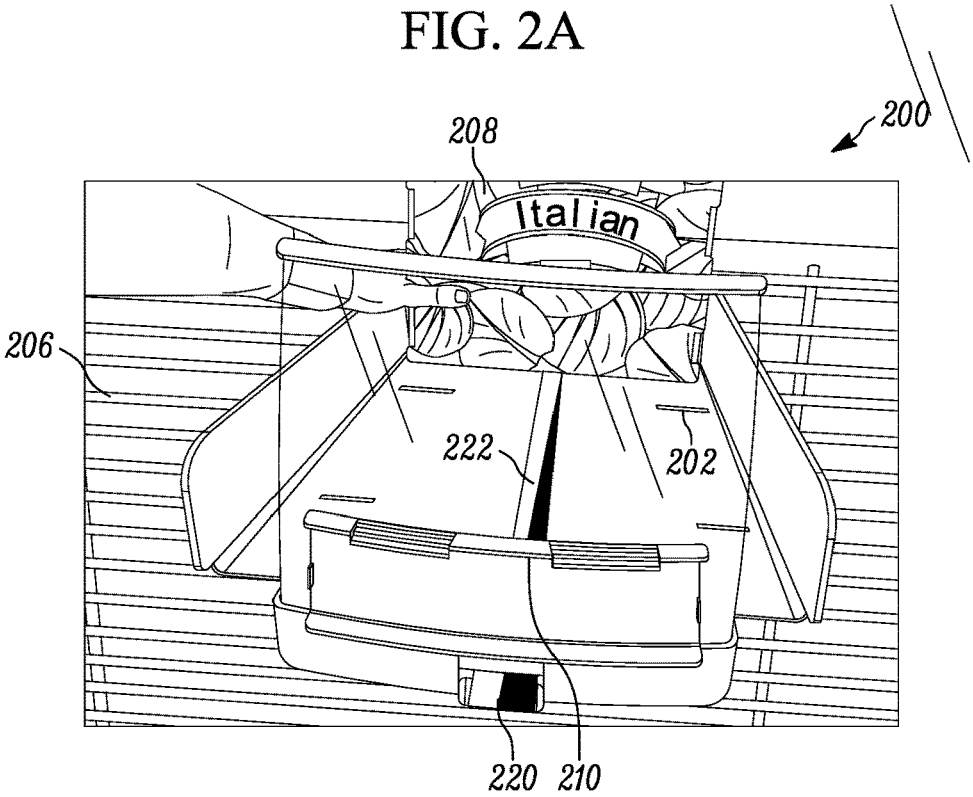
FIG. 2B is a front view of the product display merchandiser of FIG. 2A with the pusher in a second position (e.g., somewhat depleted or empty position) and the indicator indicating a second status of the merchandiser (e.g., somewhat depleted or empty).
Figure 2C:
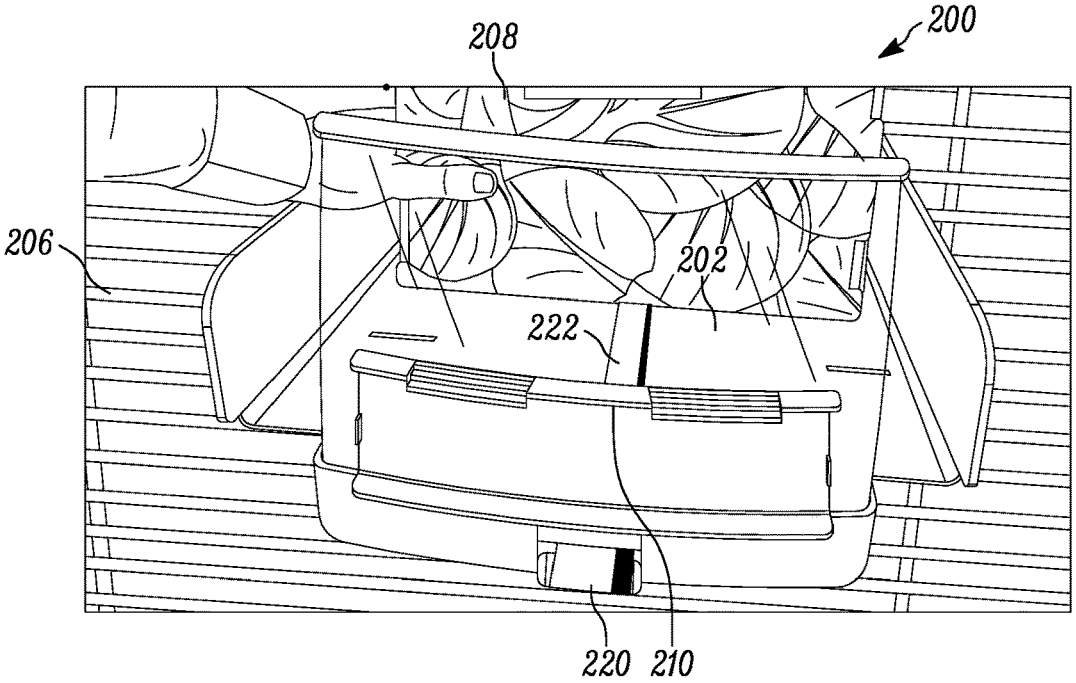
FIG. 2C is a front view of the product display merchandiser of FIGS. 2A-2B with the pusher in a third position (e.g., depleted or empty position) and the indicator indicating a third status of the merchandiser (e.g., depleted or empty).
Figure 2D:
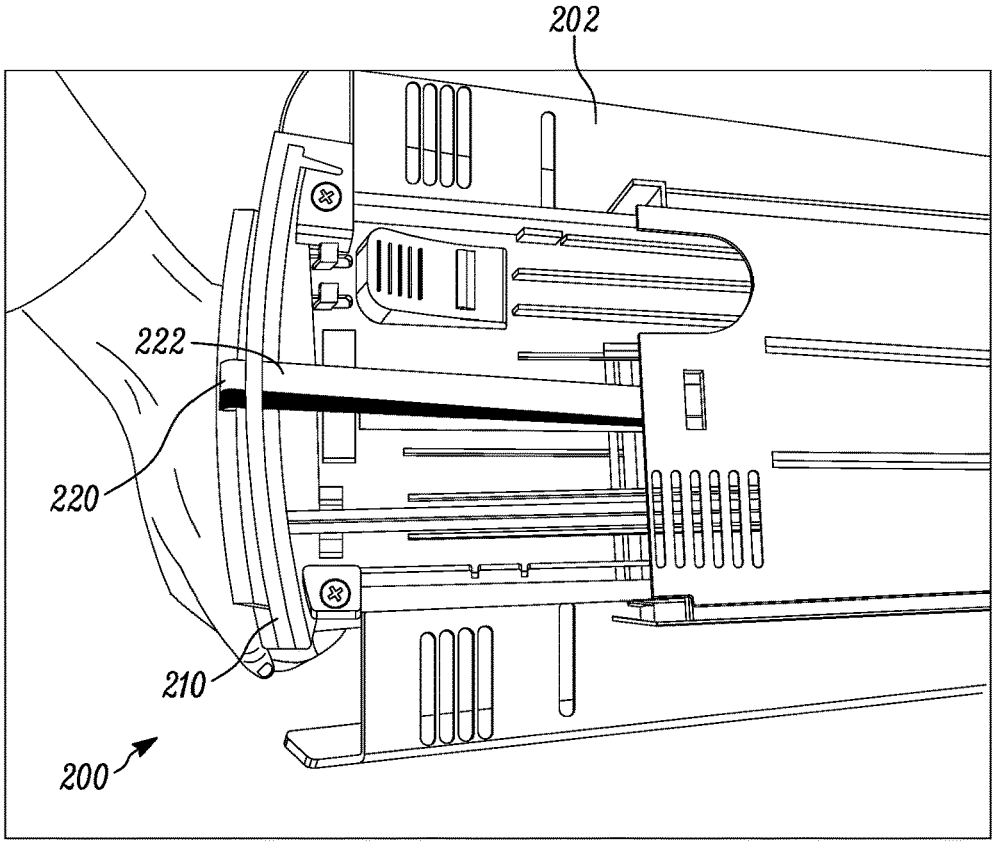
FIG. 2D is a bottom view of the product display merchandiser of FIGS. 2A-2C.

FIGS. 1A-1C illustrate an exemplary embodiment of a product display merchandiser 100, according to some forms of the inventive subject matter. The product display merchandiser 100 includes a base or tray 102 for holding a product to be displayed. The product display merchandiser 100 includes an attachment member 104 for mounting the product display merchandiser 100 to a grid 106. Such grids are often connected to the vertical risers or supports of a convention gondola shelving system. As referenced above, in alternative embodiments, the attachment member 104 may be configured to attach the product display merchandiser 100 in other ways, including mounting on a bar, mounting on a shelf, fitting into one or more horizontal tracks, or others. The tray 102 includes a track 103 along which a pusher 108 travels to push products towards a product stop, such as retaining wall 110 which, in preferred forms, is a translucent and transparent lens. The pusher 108 is biased by a biasing mechanism, such as a spring (not shown). In some embodiments a dampener counters the biasing force imposed by the biasing mechanism. Similarly, in some forms, the merchandiser may be configured so that only the pusher 108 moves with respect to the remainder of the merchandiser (e.g., with respect to the base or tray, with respect to the side members or wings, with respect to the product stop, etc.). While in other forms, the merchandiser may be configured as a drawer type merchandiser where the tray moves between a first or retracted position and a second or extended position wherein the tray extends out from the shelf or gondola upright so as to make stocking and/or restocking of the merchandiser easier to accomplish.

In the illustrated embodiment, the product display is a self-contained off-shelf merchandiser that has a base with adjustable width side members (e.g., wires, wings, etc.) and suspends from a vertical support (e.g., bar, grid, gondola upright, etc.) without the need for additional shelving. The merchandiser may comprise a tray configured to slide relative to the shelving unit from a first inward position for displaying products to a second outward position for stocking or restocking of product. The sliding tray may be mounted on a base, or the merchandiser may comprise a baseless design in which the tray is mounted on one or more arms. The arms may be coupled by one or more stabilizer. Exemplary baseless slide out merchandisers, including baseless tray merchandisers are described in International Patent Application PCT/US16/43354, titled "MERCHANDISER AND METHODS RELATING TO SAME", filed on Jul. 21, 2016, which is incorporated herein by reference in its entirety. In the embodiments shown, the tray comprises one channel for supporting products. In alternative embodiments, the tray is separated into a plurality of channels divided by dividing walls, each channel has a corresponding pusher. Exemplary multi-channel merchandisers are described in PCT/US16/43354 incorporated above. However, in alternate forms, these may be provided in forms meant for resting on shelves, such as conventional gondola shelving found in most retailers or stores. Examples of such systems are disclosed in U.S. Pat. No. 7,681,745 (issued Mar. 23, 2010), U.S. Pat. No. 7,681,744 (issued Mar. 23, 2010), U.S. Pat. No. 7,195,123 (issued Mar. 27, 2007), U.S. Pat. No. 7,168,579 (issued Jan. 30, 2007), U.S. Pat. No. 5,855,283 (issued Jan. 5, 1999), U.S. Pat. No. 5,855,281 (issued Jan. 5, 1999), U.S. Patent Application Publication Nos. 20150157142 (published Jun. 11, 2015), 20100107670 (published May 6, 2010), 20050199565 (published Sep. 15, 2005), 20050199564 (published Sep. 15, 2005), 20050199563 (published Sep. 15, 2005), 20050072747 (published Apr. 7, 2005), 20030217980 (published Nov. 27, 2003), 20030200688 (published Oct. 30, 2005) and 20030057167 (published Mar. 27, 2003), 20030056697 (published Mar. 27, 2003), U.S. Provisional Patent Application Nos. 62195847 (filed Jul. 23, 2015) and 62247744 (filed Oct. 28, 2015) and British Publication No. GB2360514 (published Sep. 26, 2001) all of which are incorporated herein by reference in their entirety. The low product indicators described herein may additionally be utilized in a rotating and/or modular merchandiser such as those disclosed in U.S. Provisional Application No. 62/447,547 (filed Jan. 18, 2017) which is incorporated herein by reference in its entirety.

In the form illustrated in FIGS. 1A-1C, the product display merchandiser 100 includes a visual indicator, such as flag 120, as the low product indicator. In a preferred form, the visual flag 120 is a flexible plastic sheet. The visual flag 120 includes a flexible portion 122, a mounting means 124, and a product graphic 126. As product 130 is depleted, the flexible portion of the visual flag 122 becomes visible. As more product is depleted, the flag is pushed forward by the pusher 108 and the flexible portion of the flag 122 bends easily upward between the retaining wall 110 and product in the merchandiser 130. The visual flag becomes increasingly visible as more product is depleted. The product graphic 126 becomes visible when product is fully depleted. The product graphic 126 serves to visually indicate what product should be stocked in the merchandiser and to provide better aesthetic than an empty merchandiser.

In other forms, the low product indicator may include an upright portion with a flexible member extending therefrom capable of being attached to a pusher or paddle on a conventional merchandiser and movable between a first position wherein neither the upright portion or flexible member are visible when the merchandiser is loaded with product, and a second position wherein both the low product indicator and upright portion are visible through the product stop of the merchandiser. The first position may be a stocked position and the second position may be an empty position. In another form, the first position may be a horizontal position or position where the flexible member is parallel to the base or tray of the merchandiser (or transverse to the product stop) and the second position may be an upright or vertical position where the flexible member is transverse to or generally perpendicular to the base or tray of the merchandiser (or generally parallel to the product stop) to indicate the need to restock this merchandiser. In yet other forms, the first position of the flexible low product indicator may be wherein the indicator is parallel to the base/tray or hidden below displayed product, and the second position may be where the indicator is bent or moved into a position protruding from, transverse to or perpendicular to the base/tray and visually apparent to signify an empty or nearly empty merchandiser or the need to restock this unit.

In a preferred form, the product stop is a transparent lens, and the upright portion contains indicia related to at least one of the following: the store the merchandiser is displayed in; the product the merchandiser is intended to be stocked with (e.g., such as a picture of same); a product category general or broad enough to encompass the product the merchandiser is intended to be stocked with (e.g., such as leafed product to represent a specific type of salad or leafed vegetable that is to be displayed in the merchandiser); and/or advertising. Thus, in some forms, the indicia is an image relating to the product to be stocked in the merchandiser or display and the low product indicator operates such that advancement of the pusher or paddle toward the front of the merchandiser advances the flexible indicator toward the product stop of the merchandiser to indicate low product inventory or count and then illustrating an image of the product that is to be displayed by the merchandiser so as to disguise the empty merchandiser or make the planogram of the overall display look more full, attractive or at least less depleted, so that product brands are readily visible and the store shelves look full, stocked at most times and generally cleaner or more impressive (i.e., fronted). The indicia can be mounted to the pusher or paddle via any type of mating relationship, such as for example, fasteners such as adhesives (e.g., glue, tape, etc.), screws, bolts, tongue & groove arrangements, snap (press or friction) fits, etc.

FIGS. 2A-2D illustrate a second exemplary embodiment of a product display merchandiser 200. The product display merchandiser 200 includes a tray 202 attached to a grid 206. The tray 202 is configured to support one or more rows of products. A pusher 208 is positioned in a track in the tray 202, the pusher 208 is biased towards a retaining wall 210. This biasing force causes the pusher 208 to push products towards the retaining wall 210. In a preferred form, the retaining wall 210 comprises a transparent lens.

Located on the front of the tray 202 is a low product indicator, such as the visual indicator 220. The visual indicator 220 comprises a coil 222 with a first end or free end connected to the pusher 208. In a preferred form, the coil 222 is the biasing mechanism that biases the pusher 208 towards the retaining wall 210 or at least affixed thereto. In alternative forms, the coil 222 is separate from the biasing mechanism. In still further alternatives, the pusher 208 does not include a biasing mechanism, and is biased towards the retaining wall 210 by gravity. The second end of the coil 222 is attached to the front of the tray 202 such that it winds about that attachment. The visual indicator comprises a portion of the wound up section of coil 222 which is visible to a user.

The coil 222 comprises at least one non-uniform surface, which changes along its length such that the portion visible on the indicator 220 can be used to determine approximately how far the pusher 208 is from the retaining wall 210. In one form, the visible surface of the coil 222 has at least two colors along substantially its entire length. The line where the two colored portions meet is angled relative to the longitudinal axis of the coil (or the side edges of the coil) such that the width of the two color segments vary along the length. In the embodiment shown in FIGS. 2A-2D, the coil 222 is black and white. Near the end fixed to the front of the tray 202, the coil 222 is predominantly black. Near the end fixed to the pusher 208, the coil 222 is predominantly white. When the pusher 208 is in a first position, spaced far away from the retaining wall 210, the indicator 220 is predominantly black. As it moves forward to a second position (FIG. 2B) and a third position (FIG. 2C) the white portion of the indicator 220 gradually gets wider while the black portion gradually gets narrower.

In alternative embodiments, the gradual change is in the form of a color gradient. The surface of the coil 222 gradually changes from a first color to a second color as it extends from a first end to a second end. Any two colors can make up the first and second colors, such as black and white, yellow and red, blue and red, etc. In some forms, the gradient comprises more than two colors.

In further alternatives, the change in the surface appearance of the coil 222 varies incrementally or is stepped instead of varying gradually. In one form, the coil comprises two colors. The portion of the coil 222 nearest the end that attaches to the front of the tray 202 is a first color, and the portion of the coil 222 nearest the end that attaches to the pusher is a second color. When the indicator 220 is the first color, a user knows that the pusher 208 is spaced apart from the retaining wall 210 by a sufficient amount such that the merchandiser 200 does not need restocked. When the indicator 220 is the second color, it indicates to the user that restocking is needed. In some embodiments, the coil 222 is longer than the tray 202, and the end attached to the pusher 208 is adjustable. By adjusting this end, the length between the pusher 208 and the indicator 220 when the indicator 220 changes colors can be adjusted. By this method a merchandiser 200 can be adjusted for thinner products so that it does not indicate that restocking is necessary until the pusher 208 is closer to the retaining wall 210 than when configured to display thicker products.

In still further alternatives, the stepped change in appearance of the coil 222 includes more than two colors or states. By this method, the indicator 220 displays analog data from which the user can determine roughly, or precisely, how many products remain in the tray 202, instead of merely displaying a binary indication of whether or not stocking is needed. In some forms, this is accomplished by having the coil 222 comprise of a plurality of colors. In alternative forms, the steps may include some sort of indicator other than color, such as indicia comprising symbols or even numbers indicating how many products remain. When the pusher is in a first position, a first indicia is visible and when the pusher is then moved to a second position a second indicia becomes visible.

FIGS. 3A-3D illustrate a third exemplary embodiment of a low product indicator for product display merchandiser. To distinguish this embodiment from prior embodiments, all elements have a 3 digit reference numeral beginning with the initial digit 3. The product display merchandiser 300 includes a tray 302 with attachment members, such as brackets 304, configured to attach the tray 302 to a grid (not shown). The tray 302 is configured to support one or more rows of products. A pusher 308 is positioned in a track in or on the tray 302, with the pusher 308 biased towards a retaining wall or product stop 310 by a spring, such as coil spring 309. This biasing force causes the pusher 308 to push products towards the retaining wall or product stop 310. In a preferred form, the retaining wall or stop 310 comprises a translucent lens, such as the transparent lens 310 illustrated in FIG. 3A.

Figure 5A:
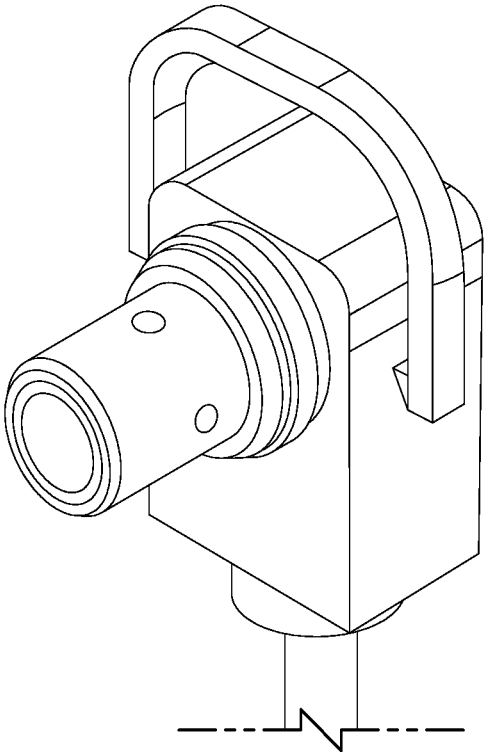
FIGS. 5A-D are perspective views of connectors or adapters that may be used to connect any of the above-mentioned low product indicators to a power source or supply.
Figure 5B:
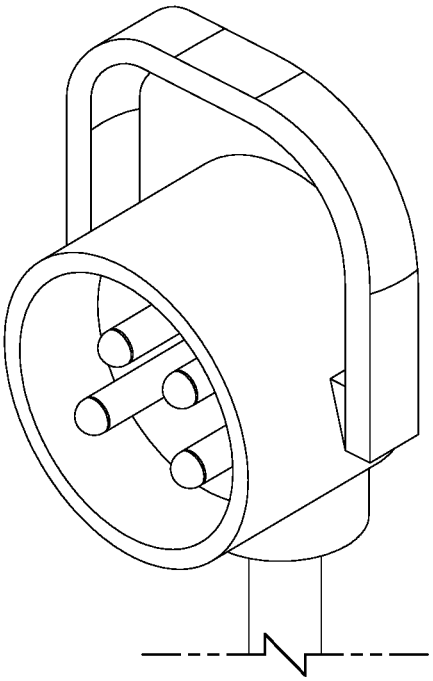
Figure 5C:
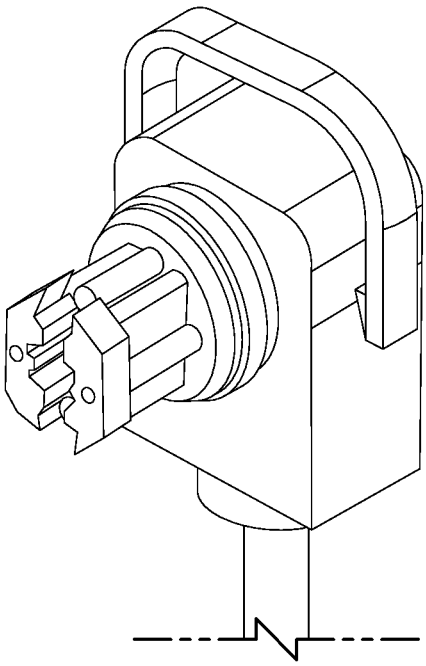
Figure 5D:
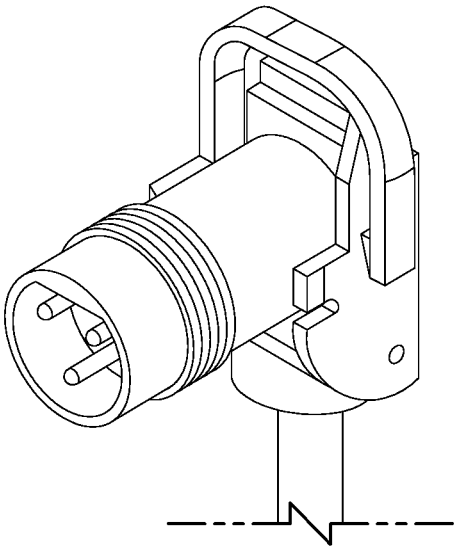

Located at or near the front of the tray 302 behind the lens 310 is a low product indicator 320. The low product indicator 320 comprises one or more lights 322, which can be any form of light, but will preferably be low voltage LED lighting. Power for the lights 322 is provided via a power connector 329, which couples the lights 322 to a power source such as a low voltage power supply (e.g., which may be a 5-24 Vdc supply, such as a 5 Vdc supply, a 12 Vdc supply or a 24 Vdc supply). The power connector 329 may comprise a plug configured to couple with a standard outlet or socket as would be found on or near a display, such as power sockets in refrigerated displays. Illustrations of such connectors for popular conventional refrigeration units such as those made by Hussmann, Hillphoenix and Kysor/Warren are illustrated in FIGS. 5A-D. Specifically, FIG. 5A illustrates a Hussmann compatible connector, FIG. 5B illustrates a Hillphoenix compatible connector, and FIGS. 5C-D illustrate Kysor/Warren compatible connectors.

Alternatively, the power connector 329 may be configured to couple with a power channel in order to form an electrical connection between said power channel and the lights 322. Exemplary light connectors and power channels for use in a shelving systems are disclosed in U.S. Pat. No. 8,979,296, titled "ILLUMINATED SHELVING" and U.S. Pat. No. 9,204,736, titled SHELVING UNIT LIGHTING SYSTEM, which are both incorporated by reference herein in their entirety. In addition, although the preferred version has a electrical cable or cable harness that directly connects the lights 322 to a power source or supply, it should be appreciated that in other forms a modular configuration may be employed to connect the lights 322 to a power source so that just the connector or adapter needs to be changed to fit the desired refrigeration unit or case. An example of such a system is illustrated in FIG. 6, which has a connector 629 (like connector 329 of FIGS. 3A-D or any of those illustrated in FIGS. 5A-D) that is configured to connect to a specific power source, such as low voltage power bus 627 which forms an uninterrupted power channel to which the connector 629 may be connected at any position there along.

Figure 6:
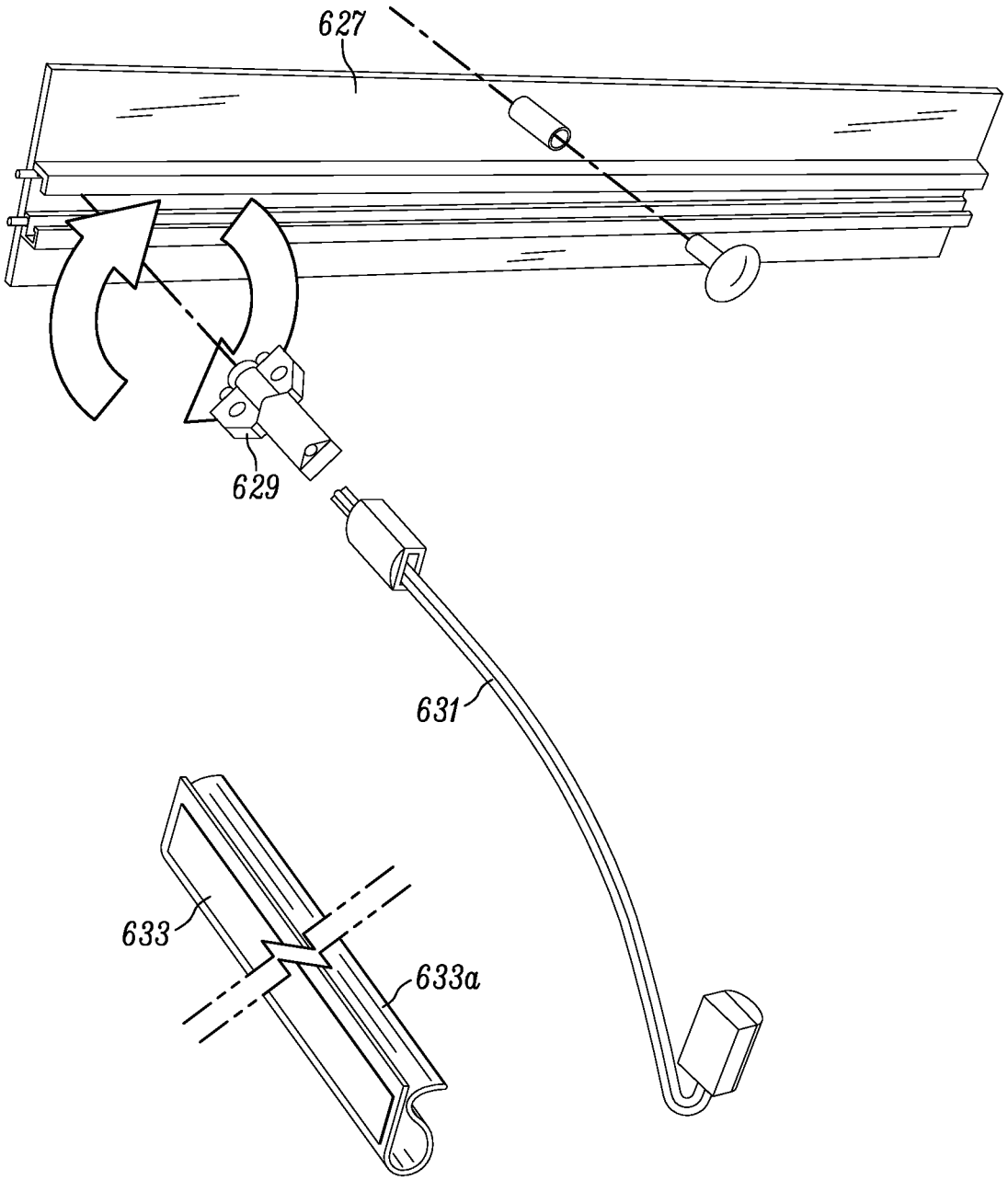
FIG. 6 is a perspective view of another connection setup that may be used to connect the above-mentioned low product indicators to a power source or supply.

In the form shown, the power bus 627 is a two conductor track and the connector 629 is a twist lock connector that is inserted into the power bus 627 at the desired position and then twisted in the direction shown by the arrows illustrated in FIG. 6 to lock the connector 629 to the power bus 627 and make electrical connection between the terminals of the connector 629 and the conductors or conductive wiring of the power bus 627. The cable harness 631 connects to the connector 629 on one end and to the lights (such as LEDs 322) and/or the low product indicator sensor or switch (such as switch 324) on the other end. In some forms, a cable support, such as cable channel 633, may be used in order to hide at least a portion of the cable or cable harness 631, such as by hiding it below the tray.

Although the cable channel 633 illustrated in FIG. 6 is an elongated channel, it should be understood that the cable support may take many different forms (e.g., such as a magnet, a wire tie, a clamp or other fastener, etc.). Similarly, while the contemplated method for fastening the cable support 633 to a surface is via an adhesive, such as a double sided tape, the fastener used to fasten the cable support could take many different forms (e.g., screws, bolts, rivets, deformable pins or press fittings, hook-and-loop fasteners, wire ties, etc.). The cable channel 633 illustrated, will preferably be connected to a surface on one end and have a movable member 633*a* that is movable between a first extended or open position wherein the cable 631 can be inserted into a center cavity of the cable channel 633 and a second closed position wherein the cable channel 633 at least partially wraps around or encircles the cable 631 to prevent same from unintentional removal from the center cavity of the cable channel 633. The movable member or end 633*a* of cable channel 633 is biased in the closed position and preferably has a distal end that forms a bell curve to make it easier to insert the cable 631 into the optional cable channel 633 by simply pressing it into the cable channel and thereby deforming the movable end 633*a* by a sufficient amount to get the cable 631 into the cable channel 633. The end of cable 631 opposite connector 629 preferably terminates in another connector or adaptor that can be connected to a mating adaptor or connector on the lights (e.g., 322) and/or the sensor (e.g., 324). In a preferred form, it will connect to a mating connector on the body of the sensor such as the connector shown in FIG. 4A.

In still further alternatives, the low product indicator is powered by a battery instead of power transmitted through a power connector 329. The battery may be a rechargeable and/or a removable battery. In the form shown, the lights (e.g., 322) are wired to the sensor (324), but form a separate module from the sensor module, with the light module connecting to the tray at one position (e.g., press fitting into the tray or snuggly fit between the tray and lens) and the sensor module connecting to the tray in a different location, separate and spaced from the light module. In other forms, the system may be configured to have the lights and sensor connected together as one assembly or a single module that can be connected to the tray as a single module, rather than separate modules.

The electrical connection between the power connector 329 and the lights 322 is controlled by a sensor or switch configured to actuate based on the location of the pusher. In the present embodiment, the sensor or switch comprises a tact switch 324. In alternative embodiments, the tact switch 324 is replaced with a switch actuated based on readings from a location sensor (e.g., infrared sensor, laser sensor, string potentiometer, varister, etc.). Exemplary sensors for use in merchandisers are disclosed in U.S. Provisional Application No. 62/279,931, titled "SENSOR FOR SELF-FACING MERCHANDISER AND RELATED METHODS" and filed on Jan. 18, 2016, which is incorporated by reference herein in its entirety.

Figure 3A:
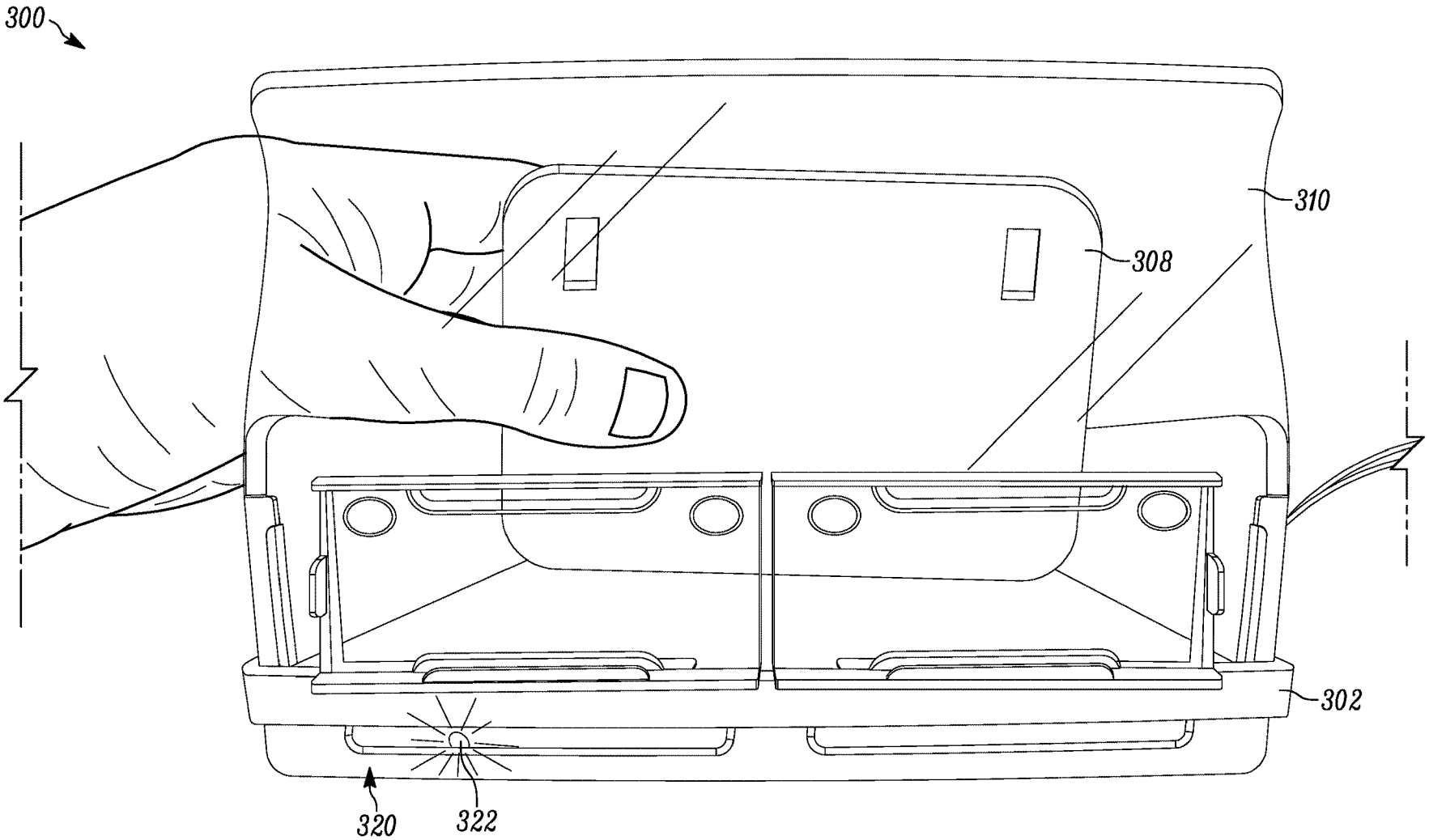
FIG. 3A is a front elevation view of a product display merchandiser having a low product indicator light in accordance to some embodiments of the present invention.
Figure 3B:
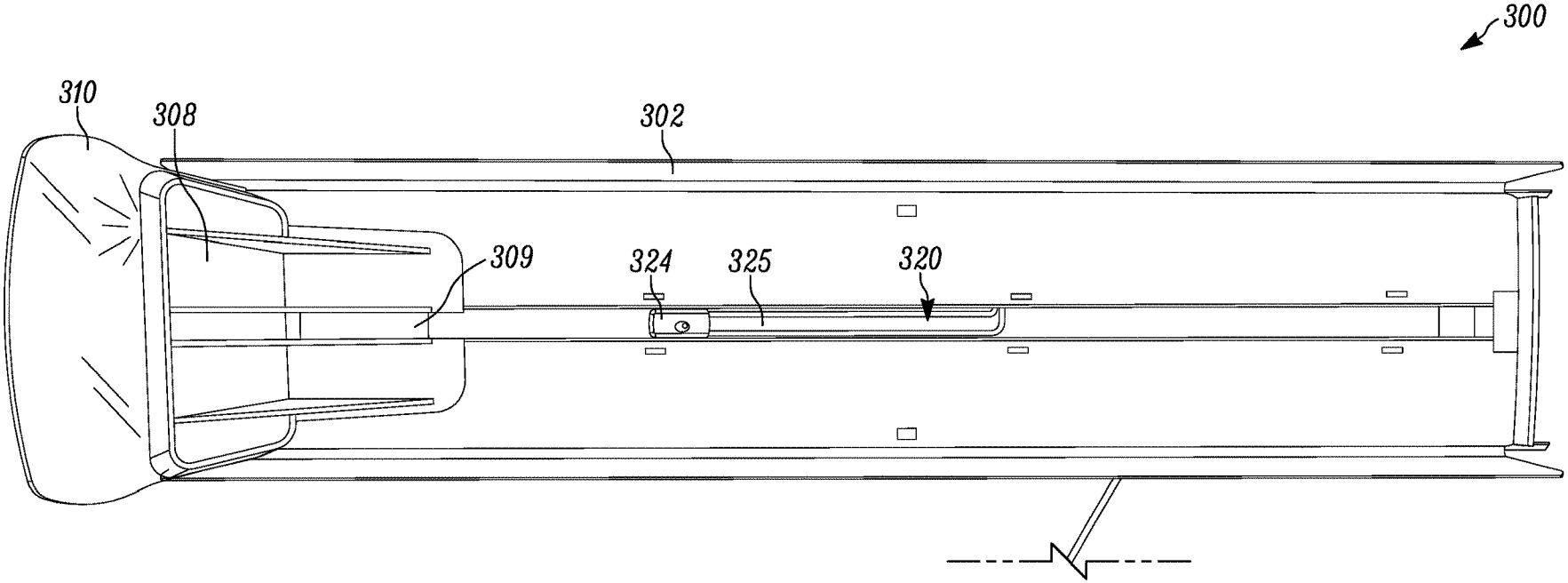
FIG. 3B is a top view of the product display merchandiser of FIG. 3A.
Figure 3C:
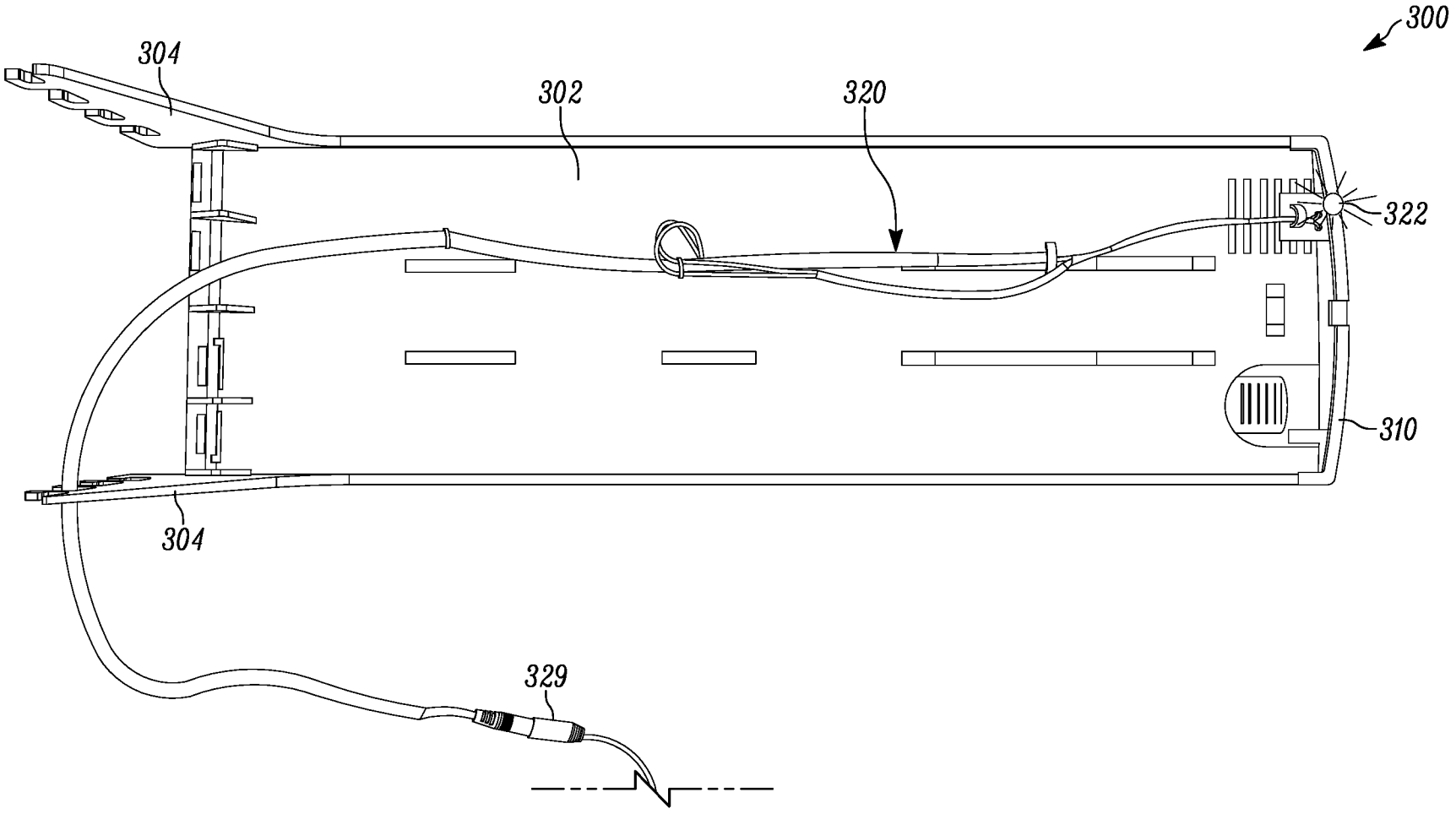
FIG. 3C is a bottom view of the product display merchandiser of FIGS. 3A-3B.
Figure 3D:
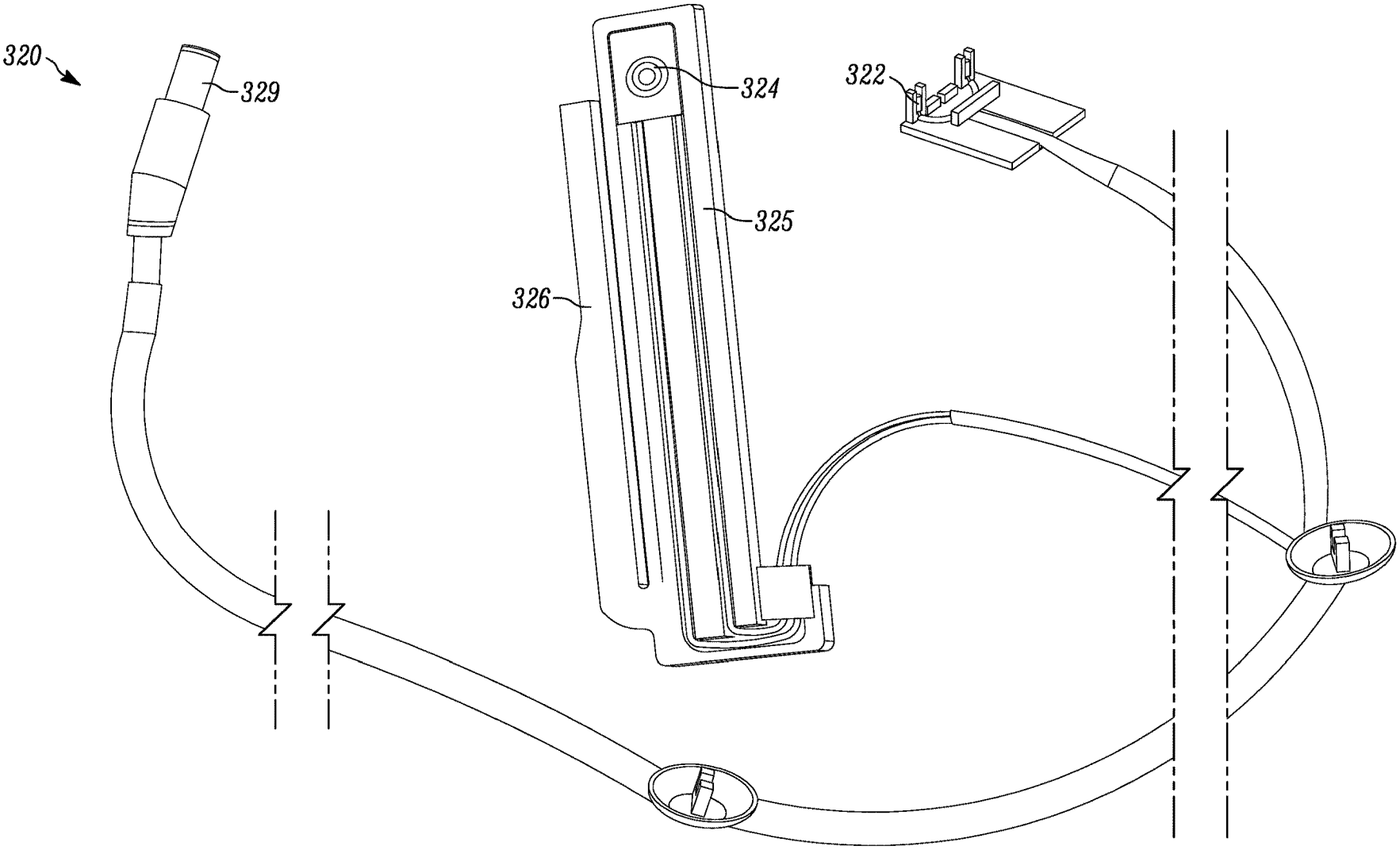
FIG. 3D is a top view of a low product indicator for use in the product display merchandiser of FIGS. 3A-3C.

As shown in FIG. 3B, the sensor or switch 324 is positioned in the track or channel in which the pusher 308 travels. When the pusher 308 is in a portion of the tray 302 predetermined by placing the switch a certain distance from the product stop or retaining wall 310, the portion being at or behind the tact switch 324, the coil spring 309 compresses the tact switch 324. In some embodiments, the tact switch is a normally closed switch electrically coupled to a light 322 indicating a low product count. When the tact switch 324 is compressed, the circuit is opened and the light 322 is shut off. When enough products are removed to allow the pusher 308 to move in front of (toward the product stop or retaining wall 310) the tact switch 324 is released which closes the circuit and powers the light 322. The light 322 alerts a user that the merchandiser 300 needs restocking.

In alternative embodiments, the tact switch 324 is acted upon by the pusher 308 or an object coupled to the pusher 308 instead of the spring 309. In still further alternatives, the tact switch 324 is coupled to the pusher 308 such that it slides with the pusher 308 relative to the tray 302. The tray 302 includes a raised bead or ledge that acts upon the tact switch 324 along a portion of the travel of the pusher 308 but not along another portion, or alternatively the normal profile of the tray 302 acts upon the tact switch 324 along a portion of the travel of the pusher 308 and a channel or recess prevents the tact switch 324 from being acted upon along another portion.

In alternative embodiments, the tact switch 324 switches between two circuits such that it powers a first light in a first state and a second light in a second state. The lights 322 are different colors, such that the first light indicates that there are a sufficient quantity of products in the tray 302 and the second color indicates that the tray 302 needs restocking. For example, a white, blue, or green light indicates that the tray 302 is stocked and a yellow, orange, or red light indicate that the tray 302 needs restocked. When the spring 309 is compressing the tact switch 324, the first light is powered and the second light is not. When the tact switch 324 is released, the second light is powered and the first light is not.

In a still further alternative, the tact switch 324 is a normally open switch. When there is sufficient products in the tray 302 such that the tact switch 324 is compressed by the spring 309, the light 322 is powered. When enough products are removed such that the tact switch 324 is released, power to the light 322 is cut. An unilluminated merchandiser 300 indicates that restocking is required.

The tact switch 324 is integrated into a body 325 inserted into the tray 302. The body 325 is held in position by friction with the sides of the channel in which it is inserted. The body 325 includes a deformable portion, such as the lever 326, which can be deformed to reduce the friction between the body 325 and the tray 302 so that the body can be moved from a first position to a second position (and any position in between) relative to the tray 302. By moving the body 325 in this manner, the location of the pusher when the tact switch 324 is activated, and therefore the number of products indicated by the lights 322, is adjusted. In operation, the body 325 is moved closer to the retaining wall 310 when the merchandiser 300 is displaying smaller products and/or products with lower turnover rate, and the body 325 is moved further way from the retaining all 310 when the merchandiser 300 is displaying larger products and/or products with a higher turnover rate.

Figure 9:
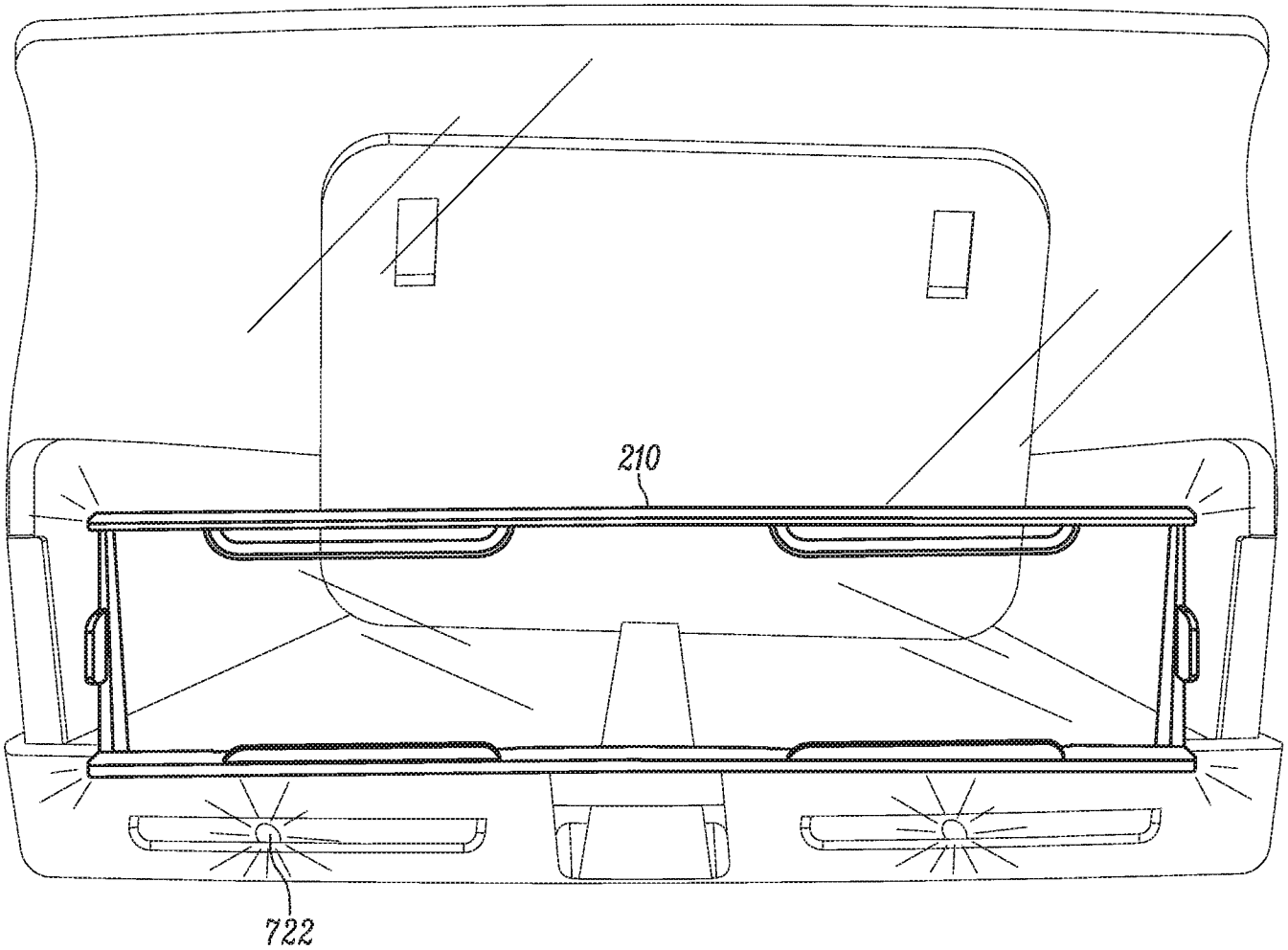
FIG. 9 is a front elevation view of a product display merchandiser having a low product indicator and a front lens which acts as a light pipe to direct the light emitted by the indicator.

In some embodiments, the lights 322 in addition to indicating product quantities, are also used to illuminate the merchandiser 300 and products contained therein. Exemplary illuminated merchandisers are disclosed in U.S. Provisional Application No. 62/409,845, titled "ILLUMINATED MERCHANDISER AND RELATED METHODS" and filed on Oct. 18, 2016, which is incorporated by reference herein in its entirety. The lights 322 may be positioned within the tray 302 or near the tray 302 so as to illuminate the front most product or the entire row of products. In some embodiments, the lights 322 are embedded in the product stop or retaining wall 310. The stop or wall 322 may be configured to direct the light from the lights 322 by serving as a light pipe, thus, increasing the size of the visual indicator or display that a store associate has to keep look for in order to know which tray needs restocking. An example of a light pipe configuration is illustrated in FIG. 9. The light from the two lights 922 in FIG. 9 is directed through the lens to illuminate the edges of the price channel as a result of light piping. The light piping can also serve to illuminate the entire lens as shown. The color used for the one or more lights 322 may be selected due to a particular product that is being displayed. For example, it may be desirable to illuminate the lens or product stop 310 with a specific color light to illuminate the lens in that color and signify to customers some parameter regarding the goods displayed in the tray. For example, in some applications, a primary light 322 will illuminate the lens 310 with a green light in order to signify that the products contained within the tray are "organic" products. As products are removed from the tray and the tray depleted of product (e.g., as the pusher moves toward the lens), a secondary light 322 may illuminate in a different color than the primary light (such as yellow, orange, white, red, etc.) in order to signal an associate that the tray needs restocking.

In alternative embodiments, the tact switch 324 is replaced with an analog switch or a plurality of switches such that the indicator 320 has more than two states. The lights 322 may comprise more than two lights such that more than two positions of the pusher can be indicated (e.g., stocked, low on products, critically low or out of products). The lights 322 may be replaced by an output that indicates the exact number of products contained in the tray 302. The analog switch may serve as a dimmer switch such that the light 322 is brightened or dimmed as products are removed.

In further alternatives, the lights 322 are remote from the merchandiser 300. In this form, the lights 322 from a plurality of merchandisers 300 are located in a single panel, such as on the end of the shelving unit, so that the user can look at the single panel and be indicated which merchandisers 300 need restocked.

In additional alternatives, the tact switch 324 or sensor is located on a different portion of the merchandiser. For example, the switch or sensor may be positioned on the back of the tray, the pusher, the lens, or a side wall.

Figure 4A:
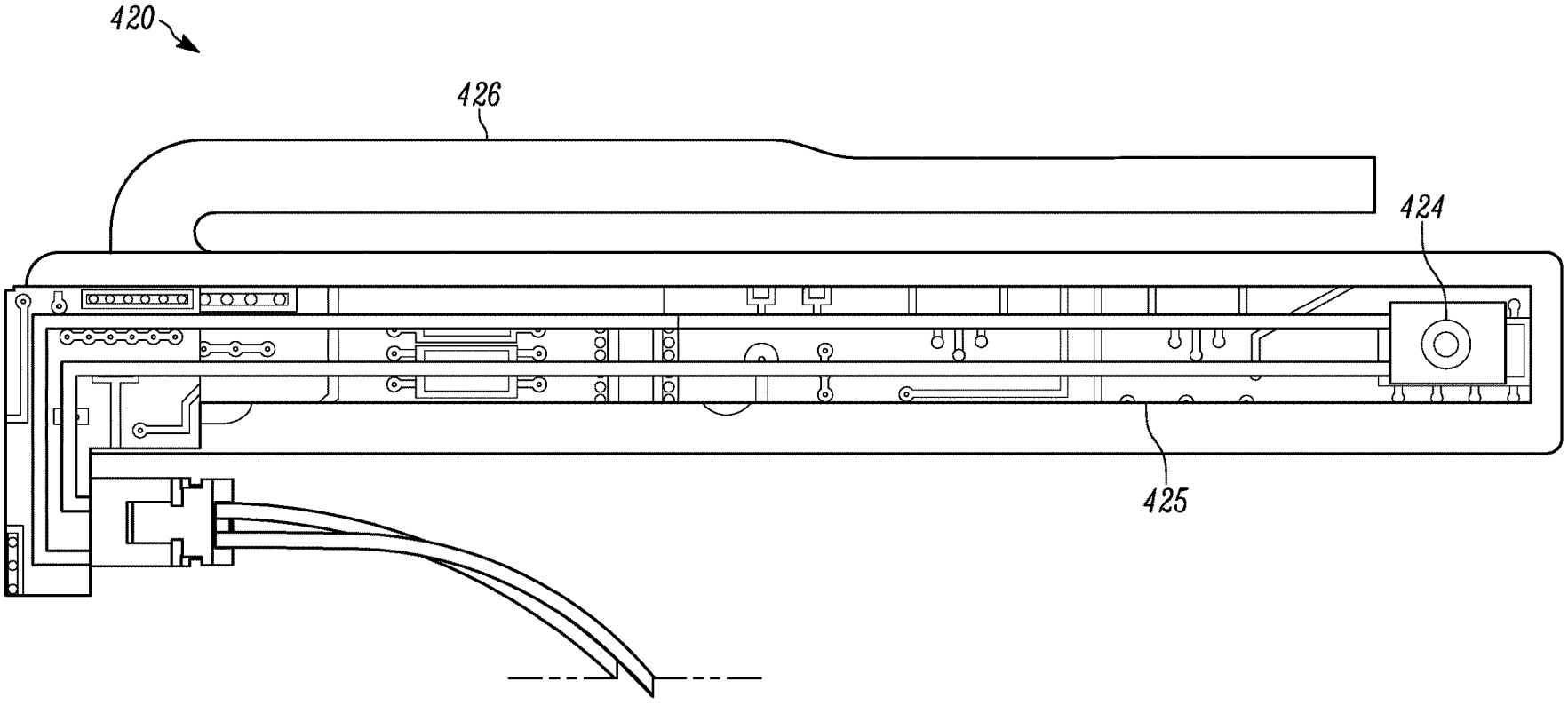
FIG. 4A is a top view of a switch and body for an alternative low product indicator for use in the product display merchandiser of FIGS. 3A-3C.
Figure 4B:
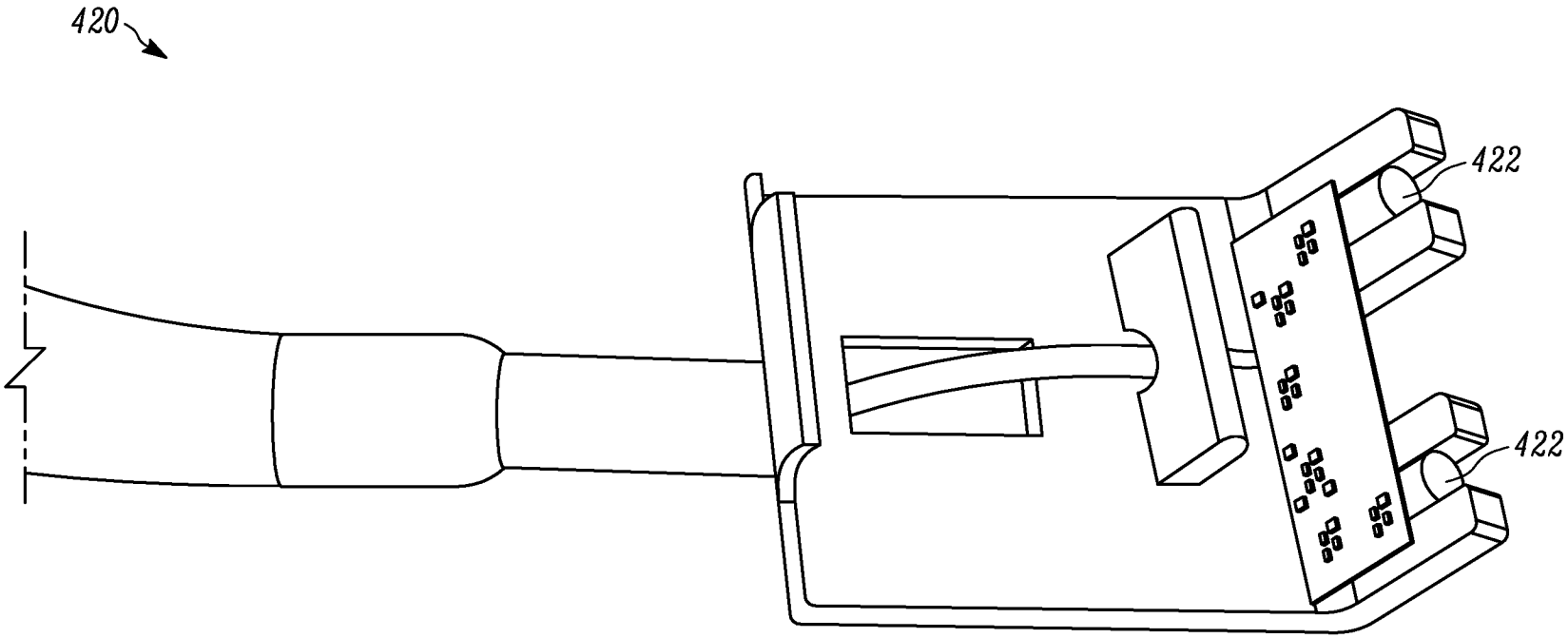
FIG. 4B is a top view of a light for an alternative low product indicator for use in the product display merchandiser of FIGS. 3A-3C.

FIGS. 4A-4B illustrate indicator 420 which is an alternative embodiment of the indicator 320. Whereas the tact switch 324 and lights 322 in the indicator 320 are attached directly to wires, the tact switch 424 and lights 422 are coupled to circuit boards. In some forms, the circuit boards are encased in a material, such as a potting material, in order to protect the electronics from moisture. Potted circuit boards may be used in refrigerated display units so that condensation on the indicator 420 does not cause shorting.

As described above, the indicators 420 and 320 can be integrated in to many different types of merchandisers, including, but not limited to, multi-channel merchandisers, merchandiser having pull-out trays, grid mounted merchandisers, bar mounted merchandisers, shelf mounted merchandiser, etc.

In a preferred form, however, the light 322 will illuminate the tray with a first color when the tray is sufficiently stocked, but then illuminate the tray with a second color different from the first color to signify that restocking needs to occur. While the illustrated embodiment uses a light 322 with two separate LEDs, in alternate forms, a single color changing LED may be used to alternate color from a first color when the tray is sufficiently stocked, to a second color different from the first when the tray needs restocking. As also discussed herein, additional lights and/or colors may be added to signify an intermediate condition (e.g., such as low product level instead of stocked and out of stock levels only). It should also be understood that while a tact switch has been described, other types of sensors or switches may be used in keeping with this disclosure. For example, product weight sensors may be used, potentiometer type sensors (e.g., variable resistor sensors, variable capacitance sensors, etc.) to detect or monitor pusher position or product itself in order to display a mechanical, electrical or electromechanical sensor like those discussed herein. It also should be understood that while the illuminated version of the low product inventory sensor has been described mainly as an attachable accessory to existing product display merchandisers so that they can be retrofitted with this technology, it should be understood that new merchandisers with this technology integrated therein are also contemplated and intended to be covered by this disclosure. Similarly, while the preferred embodiment discussed herein is configured to allow the low product indicator sensor or switch to be positionable about a plurality of positions so that the user can adjust its location to account for the particular product being displayed in the merchandiser (e.g., account for the varying shapes and sizes of products) and/or to account for a desired number of remaining product that the user wishes to be the threshold at which point the restocking indicator is displayed, it should be understood that in alternate embodiments such flexibility does not need to be afforded if not desired. For example, in some forms, the sensors may be positioned at predetermined positions without the ability to adjust same, if desired.

Figure 7A:
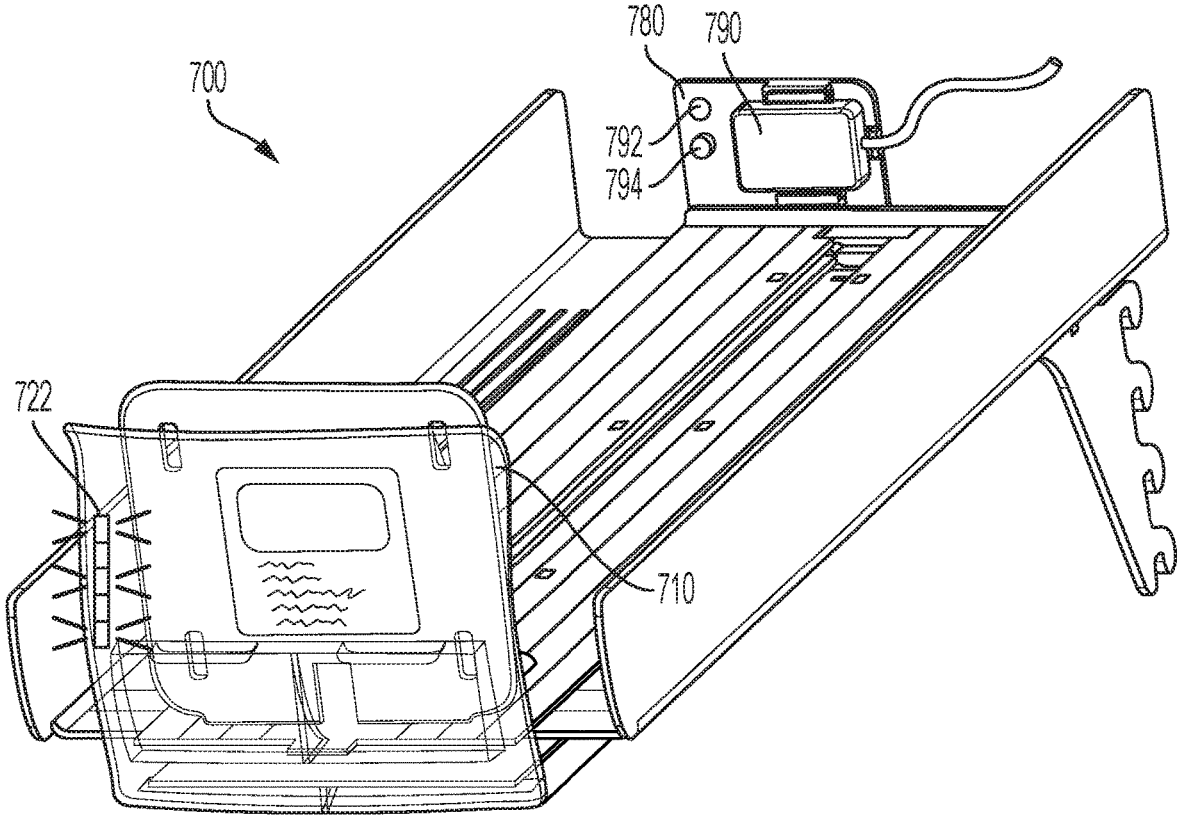
FIG. 7A is a perspective view product display merchandiser with a controller for the low product indicator mounted on the merchandiser by an adapter.
Figure 7B:
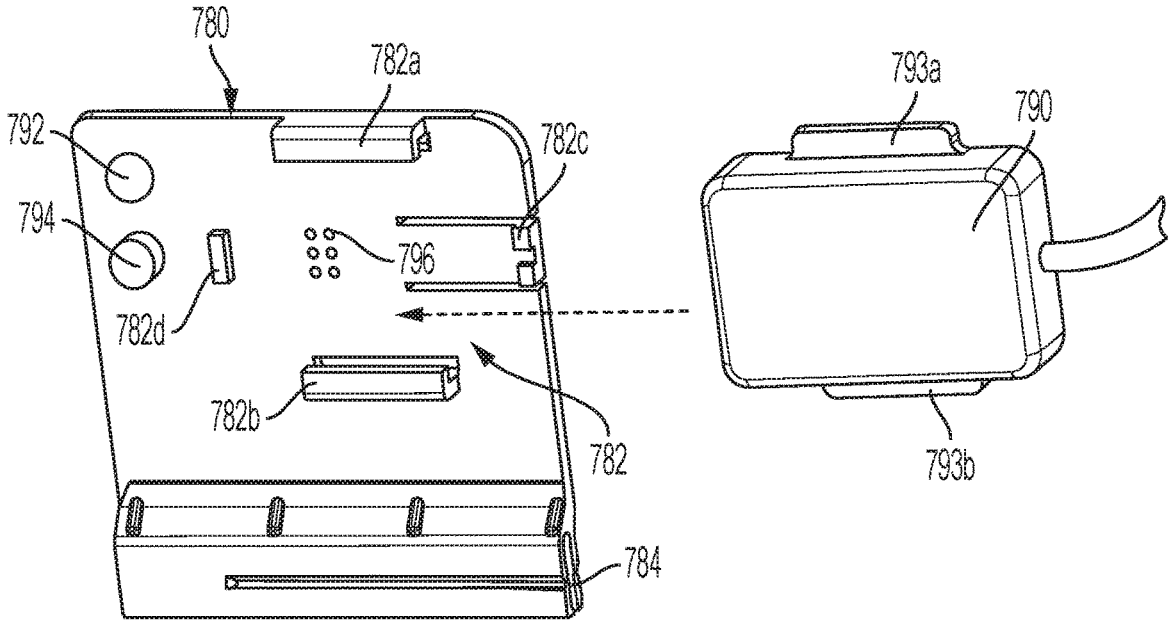
FIG. 7B is an exploded view of the controller and adapter of FIG. 7A.

FIGS. 7A-7B illustrate and adapter 780 for connecting a controller 790 to a merchandiser 700. The controller 790 is configured to control the indicators 722 located on the lens 710. The controller 790 is removably attached to the merchandiser 700 by way of an adapter 780. The adapter 780 comprises a first mating structure 782 and a second mating structure 784. The first mating structure 782 is configured to detachably couple the adaptor 780 to the controller 790. In one form, the adapter 780 has two female structures 782*a*/782*b* for receiving male mating structures 793*a*/793*b* extending from the controller 790 to be connected to the module adapter. In a preferred form, the adapter further includes a stop 782*d* (e.g., end stop) for hindering further insertion of the accessory into or onto the modular adapter. The adapter further includes a movable securing member 782*c* for securing the controller 790 to the adapter 780 once fully inserted into or onto the mating structure of the adapter. In the form shown, the securing member 782*c* is a movable arm having at least one protrusion forming a lip or shoulder that extends around an end of the accessory to prevent inadvertent removal of the controller 790 from the adapter. As illustrated, the securing member (e.g., arm) is movable between a first position wherein clearance is provided to allow the controller 790 to be connected to the adapter 780 or removed therefrom and a second position wherein the securing member prevents inadvertent removal of the controller 790 from the adapter. In a preferred form, the securing member is tapered, beveled or rounded on its outer edge or exterior side-wall so that a user can simply push the controller 790 onto the adapter resulting in the securing member automatically moving to the first position wherein clearance is provided to insert the controller 790 on the adapter. Once the controller 790 is fully inserted on the adapter the securing member moves and preferably snaps back to the second position to confirm to the user the controller 790 is fully and correctly inserted on the adapter. Then, to remove the controller 790, the user simply presses on the securing member or a structure connected thereto or in contact therewith to move the securing member to the first position so the controller 790 can be removed from the adapter. In a preferred form, the securing member is sized to position the controller 790 so that its electrical terminals are properly aligned with corresponding electrical terminals 796 on the adapter to supply power from the adapter to the controller 790 (either directly or indirectly such as through a battery as will be discussed further below).

In the form shown, the first mating structure 782 comprises four projections 782*a-d* spaced to surround the controller 790 on four sides. At least one of the projections includes a channel into which a projection of the controller fits in order to prevent the controller 790 from moving forward relative to the adapter 780. In the form shown, two opposed projections 782*a*/782*b* each include grooves into which a portion of the controller 790 housing extends. Also, at least one of the projections 782*c* is deformable, or projecting from a deformable portion of the adapter, such that it can be pushed out of position in order to permit the controller 790 to slide in and out of engagement with the adapter 780. Other means of attaching are contemplated herein. For example, the first mating structure may comprise a snap fit structure with the controller 790, or it may comprise a dovetail groove or keyhole slot into which a projection of the controller 790 extends. Alternatively, the mating structure 782 may comprise a projection configured to interact with a corresponding slot or recess in the body of the controller 790.

The second mating structure 784 is configured to detachably couple the adapter to the merchandiser 700. In one form, the second mating structure 784 comprises a slot configured to slide over a portion of the merchandiser 700. A wide variety of merchandisers have a fin or wall onto which the second mating structure 784 can couple, which allows for the modular integration of the controller 790 into different product displays.

The controller 790 comprises a processor, memory, and a transmitter which function to control the indicator 722 and optionally other electronics of the merchandiser 700. In one form, the controller 790 includes a distance sensor configured to measure the number of products currently displayed in the merchandiser. Example sensors for measuring the quantity of products is disclosed in "SENSORS, DEVICES, ADAPTERS AND MATING STRUCTURES FOR MERCHANDISERS AND RELATED METHODS" assigned to DCI Marketing, Inc. doing business as DCI-Artform which is filed on the same day as the present application having an application number to be filled in later. A variety of distance sensors can be used, including laser sensors, string potentiometers, infrared sensors, ultrasonic sensors, Hall Effect sensors, etc.

The adaptor 780 may include additional sensors 792 communicatively coupled to the controller. The additional sensors may include environmental sensors, such as temperature sensors, humidity sensors, PIR motion detectors, sound sensors, movement sensors, airflow sensors, and light sensors. In addition to operating the indicator 722 to indicate low product volume, the controller 790 may operate the indicator 722 to indicate certain statuses measured by the environmental sensors 792. For example, a merchandiser in a refrigerated unit may include a temperature and humidity sensor with an indicator to indicate to a user when the values fall outside of a predetermined acceptable range.

The controller 790 further comprises a transmitter for controlling the indicator 722. The transmitter may be wired or wireless. A wired transmitter comprises a conductive wire over which power for the indicator is conducted. The controller merely operates one or more switches to control power to the indicator. In the wireless form, the transmitter transmits a short distance wireless signal, such as an infrared signal, ultrasonic signal, laser signal, etc., which is received by the indicator. The indicator operates based on the signal received.

In some embodiments, the transmitter is outside the body of the controller 790. For example, the adapter 780 shown houses an infrared light 794. The infrared light 794 is communicatively coupled to the controller 790 to be controlled thereby. The infrared light 794 is convex shaped such that it produces a beam of infrared light, this beam is directed towards a sensor communicatively coupled to the indicator 722. The controller 790 thus operates the indicator 722 by powering on the infrared light 794.

The adapter 780 may also include an electrical connection 796 for electrically coupling to the controller 790. The electrical connection 796 includes data connections for communicatively coupling the controller to the auxiliary devices 792/794 and/or it may include power connections for providing power to the controller.

In some embodiments, the transmitter and/or a second transmitter in the controller 790 transmit data to a user indicating the status of the merchandiser. The data may be transmitted along wires and/or gateways to a centralized computer. Alternatively, the data may be transmitted via a short distance wireless communication means which is received by handheld devices used by the users. Once received by a computing device, the data transmitted by this second transmitter can be utilized in retail science applications. Exemplary methods of using data from merchandiser sensors is disclosed in U.S. Provisional Application No. 62/447,556 (filed Jan. 18, 2017) which is incorporated herein by reference in its entirety.

Figure 8A:
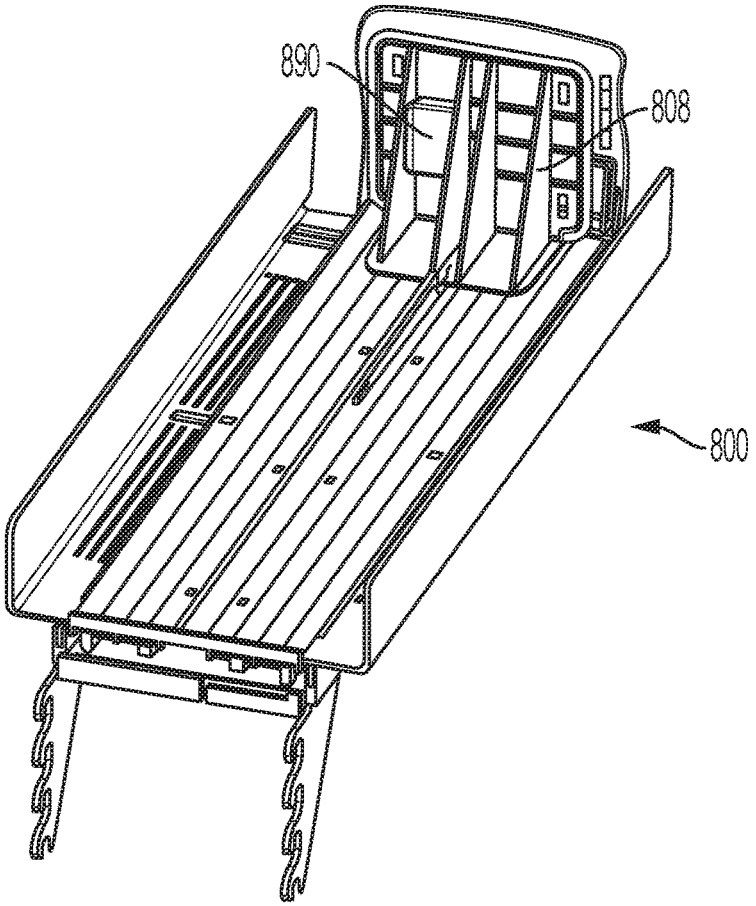
FIG. 8A is a rear perspective view of a merchandiser with a controller for the low product indicator mounted on the pusher.
Figure 8B:
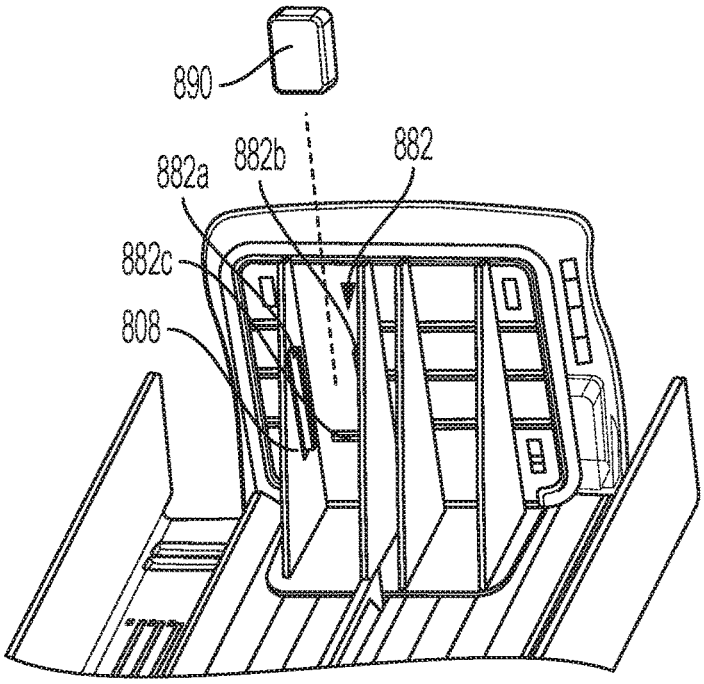
FIG. 8B is a rear perspective view of the merchandiser of FIG. 8A with the controller removed.

FIGS. 8A-8B illustrate a merchandiser 800 with an integrated mating structure 882 configured to detachably coupled to a controller 890. Similar to the first mating structure 782 described above, the mating structure 882 can take a variety of forms, each configured to secure the controller 890 in position on the merchandiser 800. In the form shown, the mating structure 882 is located on the back of the pusher 808. In alternative forms, the mating structure 882 can be located anywhere on the merchandiser 800, including the back of the tray, the bottom of the tray, the lens, a sidewall, etc. As shown, the mating structure 882 only comprises three projections 882 *a-c*. As with the mating structure 782, two of the projections 882*a*/882*b* include grooves into which portions of the controller 890 body extend. Instead of a deformable fourth projection, the mating structure is instead open to the top. Gravity holds the controller 890 in place within the mating structure, and the controller 890 can be removed by simply lifting it. In alternative embodiment the mating structure 882 can instead be exactly the same as the mating structure 782 above.

The controller 890 operates in substantially the same manner as the controller 790 described above. As with the controller 790 above, the controller 890 includes one or more integrated sensors in some embodiments. Additionally or alternatively, the controller 890 may be communicatively coupled to auxiliary sensors.

In an alternative embodiment, a plurality of merchandisers share a single controller. The merchandisers are configured to display units of the same product. The controller receives data from sensors to track both the number of products in each individual merchandiser as well as the sum of all the products spread across the plurality of merchandisers. When each of the merchandisers is low on products, the controller operates an indicator to indicate to a user that the merchandisers need restocked. However, when some of the merchandisers are low on products, but the total sum of products is still above the restocking threshold, the controller operates the indicator to indicate to a user that the products need redistributed. This redistribution prevents any voids from forming in the planogram where one merchandiser is empty while the surrounding ones are not. The indication of a need for redistribution may comprise illuminating a light of a different color than the restocking light.

In each of the embodiments above, the low product indicator comprised a visual indicator. In alternative embodiments, the indicator additionally or alternatively comprises nonvisual indicators. The nonvisual indicators may comprise sound emitting devices or vibrators to audibly and/or tactility alert users. In other alternatives, the indicator comprises a wireless communication means that is received by a portable device held by the users, such as a handheld computer or pager. In still further embodiments, the indicator may comprise light outside of the visual spectrum, such as infrared light or ultraviolet light. The users can have glasses or goggles that make the indicator visible to them while not being visible to customers. Similarly, the audible signal may be outside of the frequencies audible by humans, but audible to users through the use of specialized earphones.

In still further alternatives, the low product indicator comprises a digital display. The digital display may simply display a number representing the number of products currently displayed. Alternatively, the display may display additional information, such as the identity of product intended to be stocked in an empty merchandiser.

In alternative embodiments, the indicator includes additional lights for indicating statuses other than low product levels. For example, the indicator includes blue lights or red lights to indicate sales.

In additional alternatives, the low product indicator is adapted for use in application other than product displays. For example, the low product indicator may be implemented in a warehouse or storage room to indicate when inventory of a product is low triggering reordering of the product.

In each of the embodiments above, all elements have a 3 digit reference numeral. The first digit refers to the embodiment and the last two digits refer to the element. Therefore, unless expressly distinguished, elements sharing the last two digits of a reference numeral as an element in a different embodiment are assumed to operate in substantially the same manner. Thus, several different concepts and features have been disclosed for identifying low product inventory conditions for product display merchandisers such as tray type merchandisers.

In addition to the above-mentioned embodiments, it should be understood that a variety of methods are also disclosed herein. For example, a method of indicating a low product inventory condition is disclosed herein as is a method for displaying product. Similarly, methods for manufacturing and/or operating product merchandise displays are also disclosed herein, as are methods disguising empty merchandisers and/or methods for making store shelves look full, stocked or cleaner at most times. In addition, a method of moving a low product indictor between a first (e.g., stocked or hidden) position and a second (e.g., empty or displayed) position is disclosed. These and other methods related to the subject matter set forth herein are intended to be covered by this disclosure.

It should also be understood that while certain features have been described with certain embodiments, these features may be intermixed or interchanged with one another to form other embodiments as desired. All features disclosed herein are intended to be used in any of the embodiments disclosed herein either in lieu of similar features or in combination with other features. Further, while the detailed description refers to specific examples in the drawings and illustrations, these examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical and other changes can be made to the example embodiments described herein.

Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments of the invention, which are defined only by the claims that will ultimately be included in this application.

The invention claimed is:

1. A product display merchandiser comprising:

a tray extending in a longitudinal direction;

a spring-biased pusher slidable in the longitudinal direction within the tray; and a visual indicator coupled to the tray, the visual indicator comprising at least one light activated by a switch, the switch configured to be actuated when the pusher is within a predetermined portion of the tray;

wherein at least a portion of the pusher is positioned within a channel extending in the tray in the longitudinal direction and at least a portion of the switch is positioned within the channel; and wherein the switch is slidable in the longitudinal direction within the channel to adjust the predetermined portion of the tray.

2. The product display merchandiser of claim 1, wherein the switch is acted upon by one of the pusher and the spring biasing the pusher.

3. The product display merchandiser of claim 1, wherein the switch is a tact switch.

4. The product display merchandiser of claim 1, wherein the at least one light comprises a first light having a first color and a second light having a second color.

5. A method of displaying products comprising:

providing a product display merchandiser comprising:

a tray extending in a longitudinal direction from a first end to a second end;

a spring-biased pusher slidable in the longitudinal direction within the tray; and a visual indicator coupled to the tray, the visual indicator comprising at least one light activated by a switch, the switch configured to be actuated when the pusher is within a predetermined portion of the tray, wherein the switch is located within a channel in the tray, wherein at least one of the pusher and the spring biasing the pusher acts upon the switch, wherein the at least one light is located near a front of the tray, and wherein the predetermined portion of the tray extends between the first end of the tray and a predetermined position between the first and second ends of the tray;

sliding the switch in the longitudinal direction within the channel to adjust the predetermined portion of the tray; and moving the pusher from a first position at which the switch is in a first state and the at least one light is not powered to a second position at which the switch is in a second state and the at least one light is powered.

6. The method of claim 5, wherein moving the pusher comprises:

moving the pusher from the first position wherein the at least one of the pusher and the spring acts upon the switch to the second position at which the switch is not acted upon.

7. A product display merchandiser comprising:

a body having a surface or structure for mounting the merchandiser to a shelf, bar, grid or wall, and defining a product channel for displaying product for purchase; and a sensor for identifying product inventory condition and triggering a restocking indicator when a threshold has been reached or surpassed to indicate a need for restocking of the merchandiser, wherein the restocking indicator is mounted on the body;

wherein the body has a recessed track extending along the product channel; and wherein the sensor is slidable within the recessed track to adjust the threshold that indicates the need for restocking of the merchandiser.

8. The product display merchandiser of claim 7 further comprising at least one light which illuminates when the threshold has been reached or surpassed to indicate the need for restocking of the merchandiser.

9. The product display merchandiser of claim 7 further comprising a power cable for connecting the sensor and/or at least one light to a power source.

10. The product display merchandiser of claim 9 further comprising a power strip capable of having a plurality of power cables connected thereto and being connected itself to the power source.

11. A low product inventory sensor comprising:

a sensor for determining when a product inventory threshold has been reached or surpassed to indicate a need for restocking;

a visual indicator for signaling a store associate when the threshold has been reached or surpassed to indicate the need for restocking;

a power cable connected to the sensor and/or visual indicator and having an adapter for connecting the cable to a power supply;

a fastener for connecting the visual indicator to a product display merchandiser so the visual indicator can be connected to new or existing product display merchandisers; and a body that holds the sensor thereupon, the body being configured to slide within a recessed track in the product display merchandiser, the body having a deformable portion that can be deformed to reduce friction between the body and the recessed track so that the body and sensor can be moved relative to the product display merchandiser once installed within the recessed track.

12. The low product inventory sensor of claim 11 wherein the visual indicator is a light and the fastener is configured to connect the light proximate a product stop or lens of the product display merchandiser so that the light is readily visible from a front of the product display merchandiser.

13. The low product inventory sensor of claim 12 wherein the fastener connects the light proximate the lens of the product display merchandiser to at least partially illuminate the lens.

14. The low product inventory sensor of claim 13 wherein the lens has a light channel for illuminating at least a face of the lens and the fastener positions the light proximate the light channel for illuminating the face of the lens.

15. The method of claim 5, further comprising:

powering a first light when the switch is in the first state; and powering a second light when the switch is in the second state.

16. The product display merchandiser of claim 1, wherein the tray has first and second ends in the longitudinal direction, and wherein the predetermined portion of the tray extends between the first end of the tray and a predetermined position between the first and second ends of the tray.

17. The product display merchandiser of claim 1, wherein the switch is acted upon by the spring biasing the pusher.

* * * * *